United States Patent [19]

Dubois

[11] 4,005,905

[45] Feb. 1, 1977

[54] EXCAVATING MACHINE

[75] Inventor: Michel Dubois, Ittre, Belgium

[73] Assignee: Linden-Alimak AB, Skelleftea, Sweden

[22] Filed: Aug. 21, 1974

[21] Appl. No.: 499,578

[30] Foreign Application Priority Data

Aug. 22, 1973 Luxembourg ..... 68289

[52] U.S. Cl. ..... 299/31; 180/8 R; 299/57; 299/75

[51] Int. Cl.[2] ..... E21D 9/10

[58] Field of Search ..... 299/31, 32, 33, 55, 299/56, 57, 64, 75, 71, 72; 180/8 R, 8 C, 8 D

[56] References Cited

UNITED STATES PATENTS

| | | | |
|---|---|---|---|
| 2,327,928 | 8/1943 | Osgood | 299/72 |
| 2,452,632 | 11/1948 | Cameron | 180/8 D |
| 2,619,338 | 11/1952 | Lingren | 299/75 X |
| 2,973,949 | 3/1961 | Densmore | 299/64 |
| 3,512,597 | 5/1970 | Baron | 180/8 C |
| 3,663,054 | 5/1972 | Dubois | 299/31 X |
| 3,776,592 | 12/1973 | Ewing | 299/75 X |

*Primary Examiner*—Ernest R. Purser

[57] ABSTRACT

A machine for excavating underground galleries, comprising a frame displaceable within a gallery, an arm pivotally connected to said frame, means for adjusting the orientation of said arm in a plurality of directions, said arm having a rotary tool carrier provided with cutting tools distributed over the periphery thereof located to operate in a single plane perpendicular to the direction of the arm, the machine having means enabling the pivotal connection between the arm and the frame to occupy two distinct alternative positions, in each of which positions the means supporting said pivotal connection can be immobilized.

50 Claims, 34 Drawing Figures

EXCAVATING MACHINE

The invention relates to an excavating machine such as a machine for excavating underground galleries and relates more particularly to a machine comprising a frame which can be displaced relative the gallery floor, an arm connected to the frame via a pivotal connection having at least two distinct pivoting axes perpendicular to the direction of forward movement of the frame, a rotary tool carrier at the end of the arm, and cutting tools on the tool carrier. The prior art machines of the kind specified are usually called "universal arm machines".

Machines in accordance with the invention may be used for forming galleries in mines, or for forming underground tunnels e.g. for roads or railways, or may be utilised for other excavating purposes. In this specification the word "gallery" is used in a general sense, and is intended to embrace tunnels and other such excavations.

Universal arm excavating machines have the advantage of enabling galleries of large cross-section to be excavated with relatively small tool carriers. They also enable galleries of different shaped cross-sections, for instance, semi-circular, trapezoidal or rectangular cross-sections to be excavated. Compared with the so-called "full-section" machines which can only excavate galleries of one size and one cross sectional shape they are more versatile, take up less space and are less expensive.

Generally the prior art universal arm machines are designed for their tools to attack the rock adjacent the gallery frontally i.e. the tools approach the surface of the rock perpendicularly to the surface of the rock. The rock is therefore removed as grains having very fine grain size, and this has the double disadvantage of a high power consumption for the machine and a considerable quantity of dust is made. Another disadvantage of the universal arm machines is that they are not very stable during operation.

There are other prior art machines comprising at least one tool carrier disposed on an arm which is not universal but can rotate only around a horizontal or vertical pivotal axis. The tool carrier of this second kind of machine is a flat milling cutter bearing on its periphery cutting tools which all operate in the same plane, perpendicular to their axes of rotation, which is normal to the axis of rotation of the arm. The tool carrier makes a semi-tangential cut — i.e. it attacks the rock substantially tangentially to a spherical surface which it describes and, by a subcutaneous action, cuts the rock up into "slices" or "chips". It directly destroys or pulverises a fraction of the rock and detaches the other fraction of the rock from the wall of the gallery in pieces of considerable size.

After having finished cutting a "chip" over the whole surface of the excavation front i.e. the portion of the wall of the gallery that is being attacked by the machine, the machine is advanced by one step and starts to cut the following "chip". The "chip" cut from the rock between each advancing step is therefore disposed between two spheres whose centres spaced from each other by a distance equal to the length of the step. In cross-section the "chip" has the form of a crescent, its greatest thickness being equal to the length of the step taken.

Of course this cutting technique destroys only a small portion of the rock and is more economical than a frontal attack in which tools act perpendicularly to the rock face, moreover it produces pieces of rock of considerable size and raises less dust. This is particularly advantageous if the rock is coal, or if the rock is granite or the like, as the pieces of rock may be of more value than pulverised rock. Another advantage of the methodis that the length of each step advanced can be selected as required in dependence on the varying difficulty of excavation, thus proportioning the thickness of the "chip" to the nature of the rock, so that harder rocks can be dealt with than those which the prior art universal arm machines can attack.

On the other hand, the prior art machines performing semi-tangential cutting have a number of disadvantages, since a milling cutter cannot be introduced into the rock at any place on the spherical front which it excavates. The milling cutter must be retractable outsise its excavating zone so as not to impede the forward movement of the machine during each step. All that it can do is to start cutting a fresh "chip" of rock from a wall at one of the points of the crescent, since it is only at the point that the milling outer can leave the front and be retracted into the reentrant portion of its trajectory. This fact limits the cross-sectional shape and size of the gallery, and also means that not much rock is yielded at the start of cutting, since in forming the tapering part of the crescent shape "chip" the volumetric proportion of rock destroyed in relation to the volume of rock detached is less than in forming the thick part of the crescent shaped "chip".

The present invention seeks to provide an excavating machine in which the above described disadvantages of prior proposed excavating machines are reduced or obviated.

According to this invention there is provided a machine for excavating underground galleries, comprising a frame displaceable within a gallery, an arm pivotally connected to said frame, means for adjusting the orientation of said arm in a plurality of directions, said arm having a rotary tool carrier provided with cutting tools distributed over the periphery thereof located to operate in a plane perpendicular to the direction of the arm the machine having means enabling the pivotal connection between the arm and the frame to occupy two distinct alternative positions, in each of which positions the means supporting said pivotal connection can be immobolised.

In order that the invention may be more readily understood, and so that further features thereof may be appreciated the invention will now be described by way of example with reference to the accompanying drawings in which.

Figure 8:
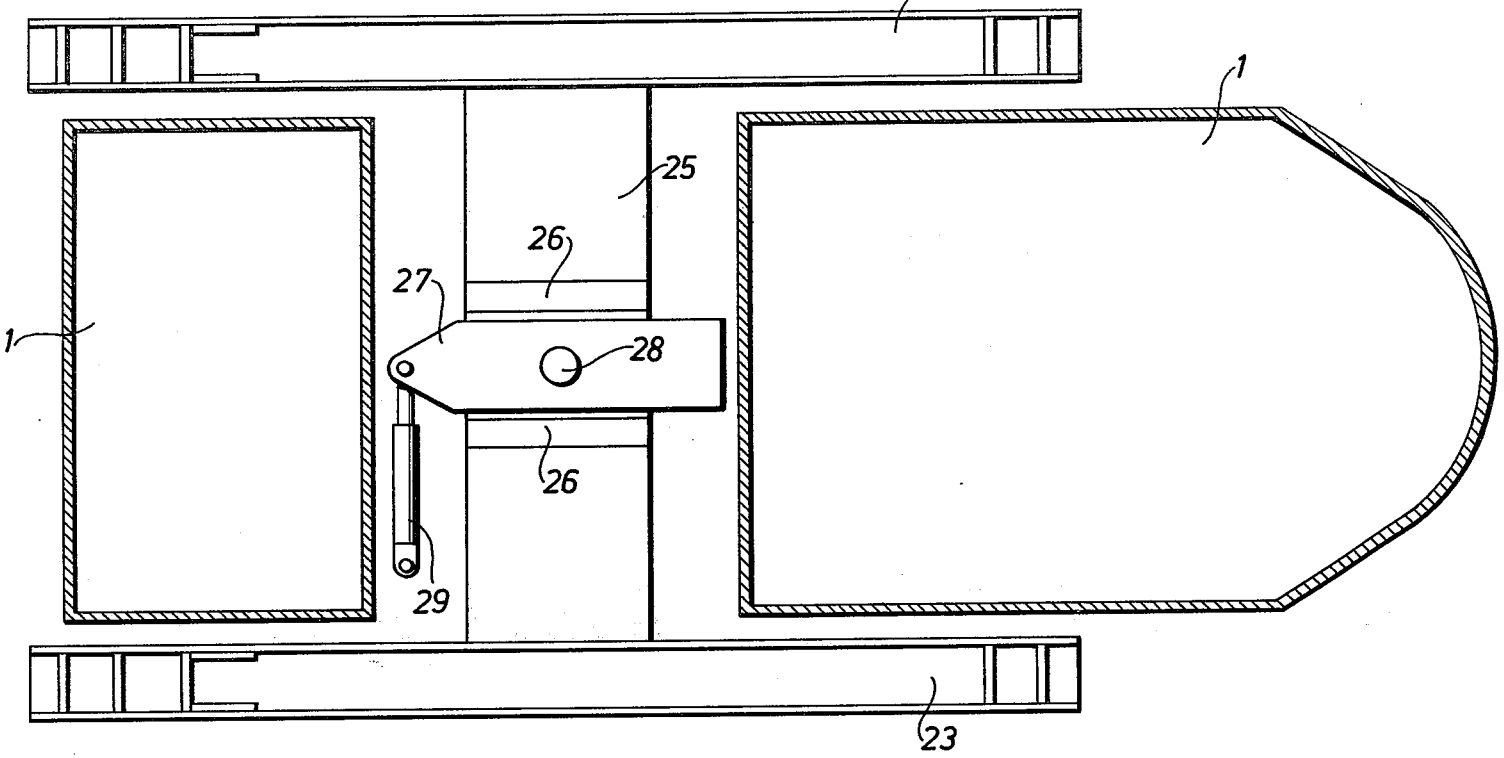
Figure 9:
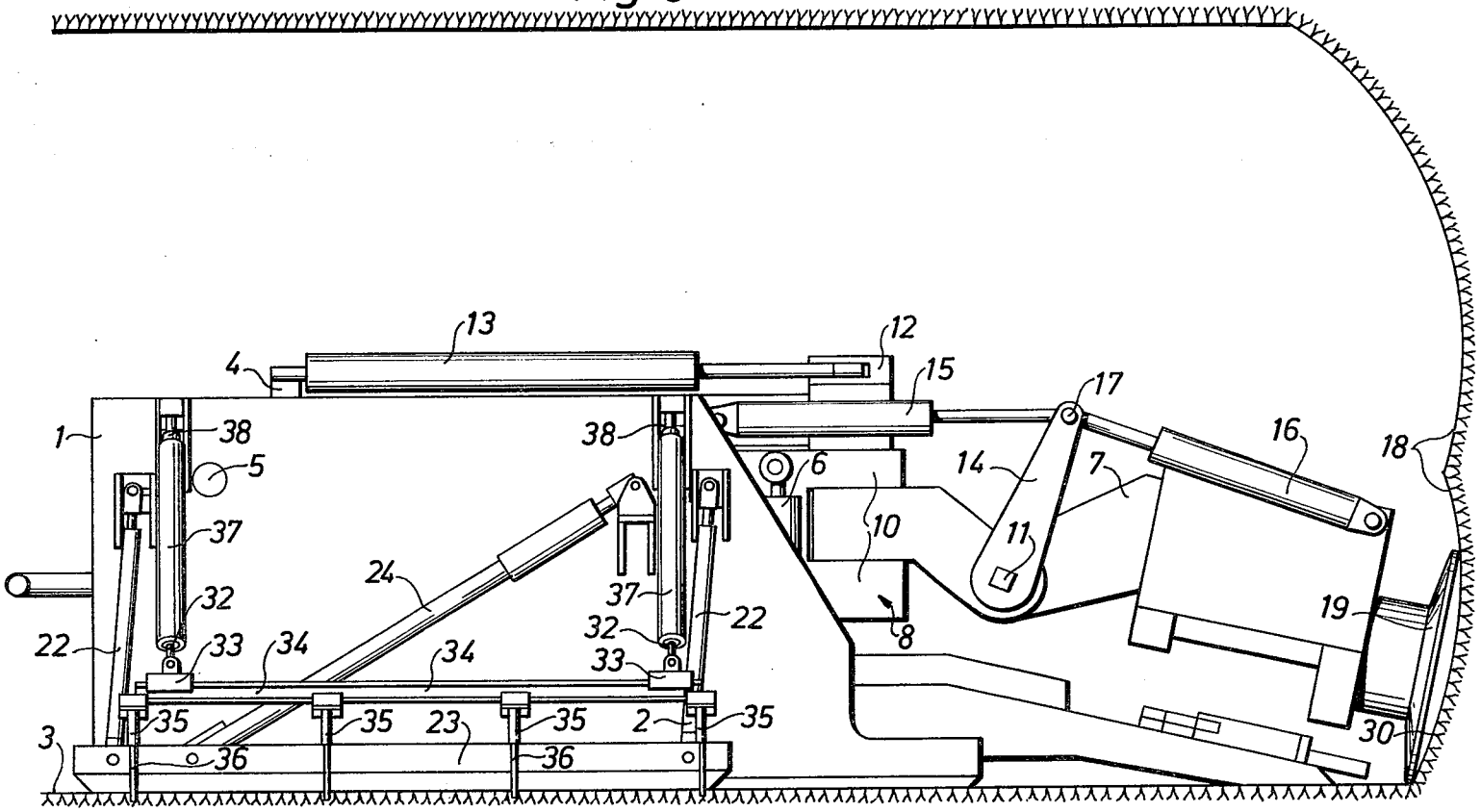
Figure 10:
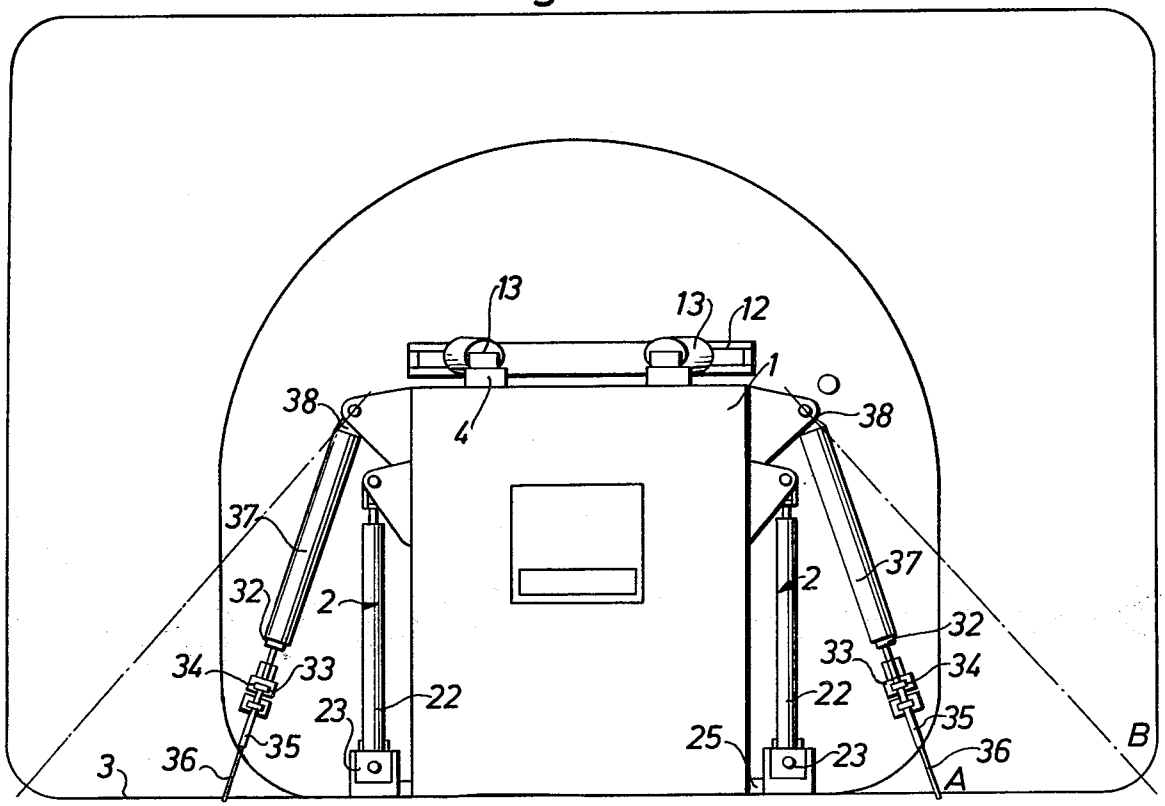
Figure 11A:
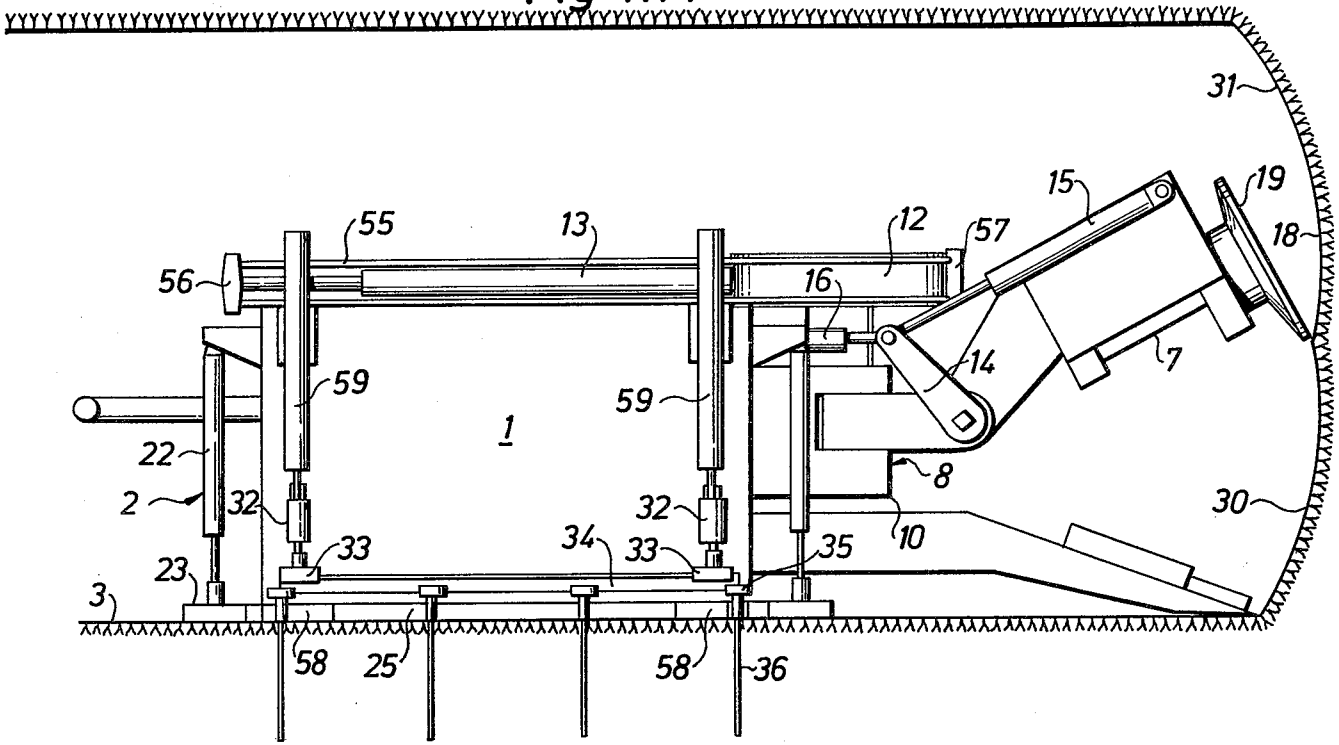
Figure 11B:
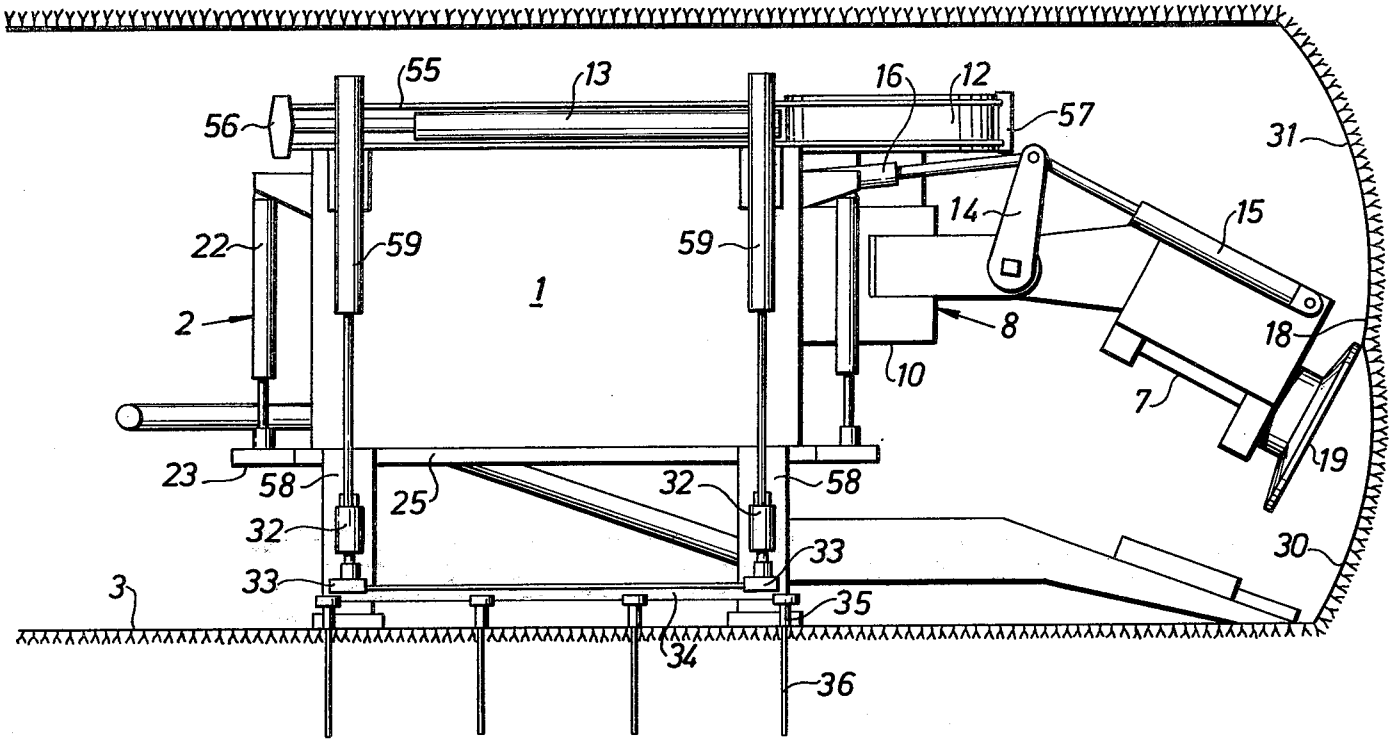
Figure 12:
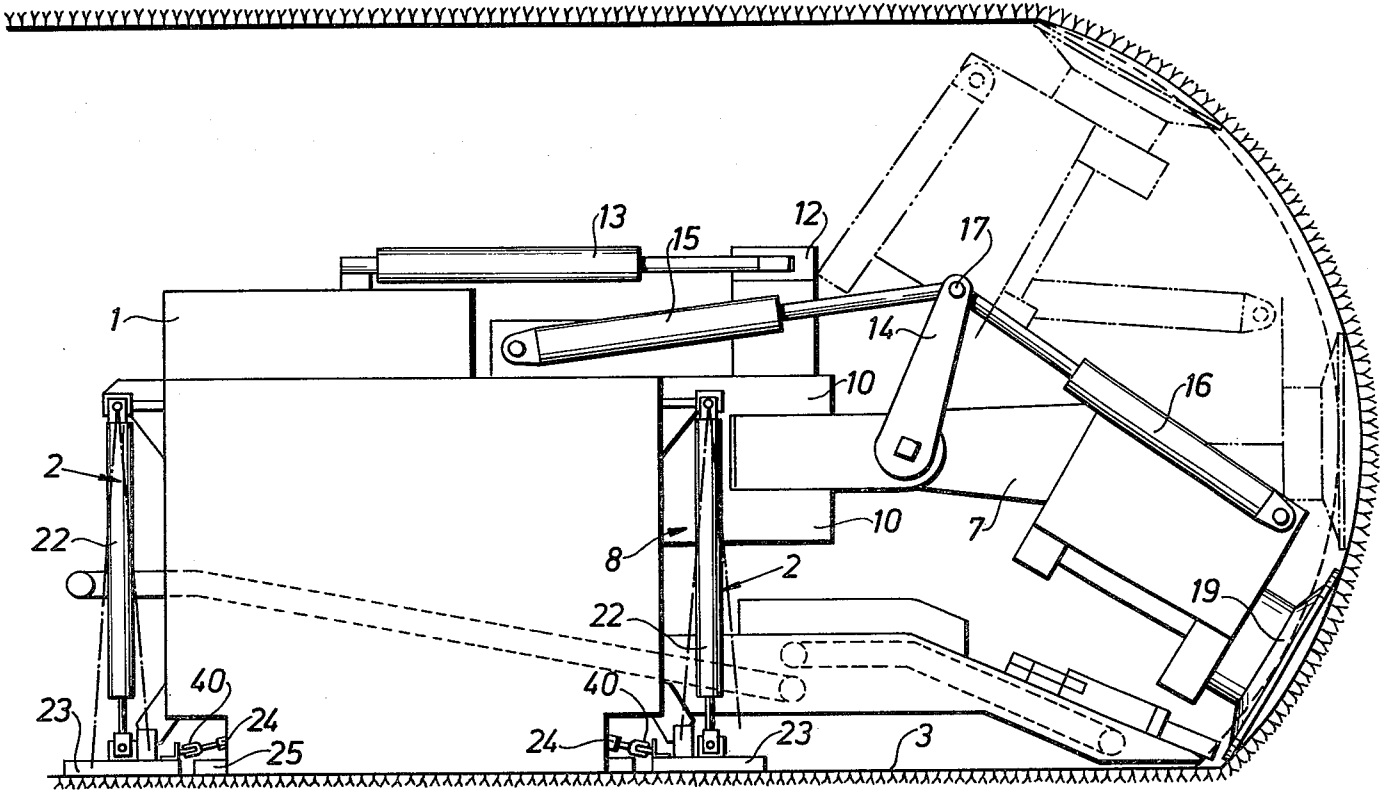
Figure 13:
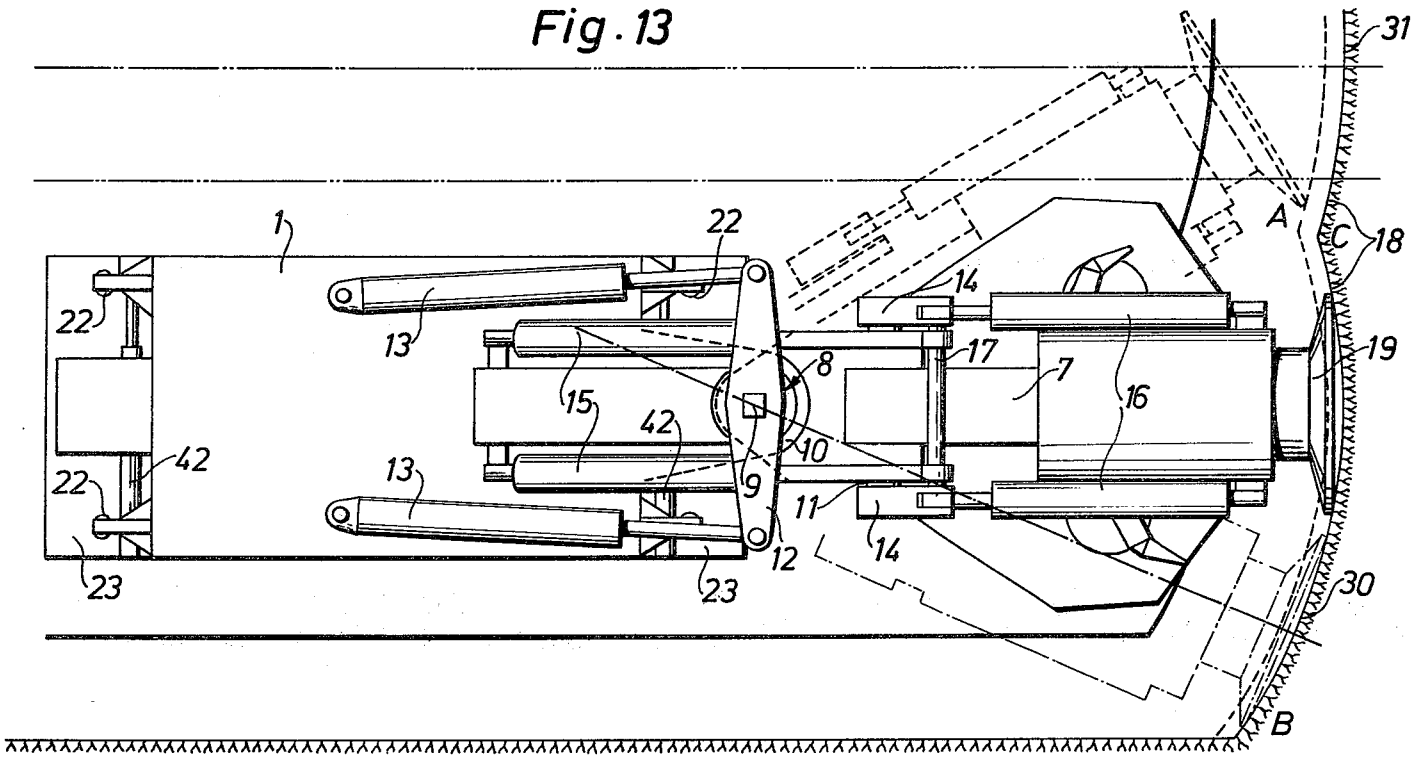
Figure 14:
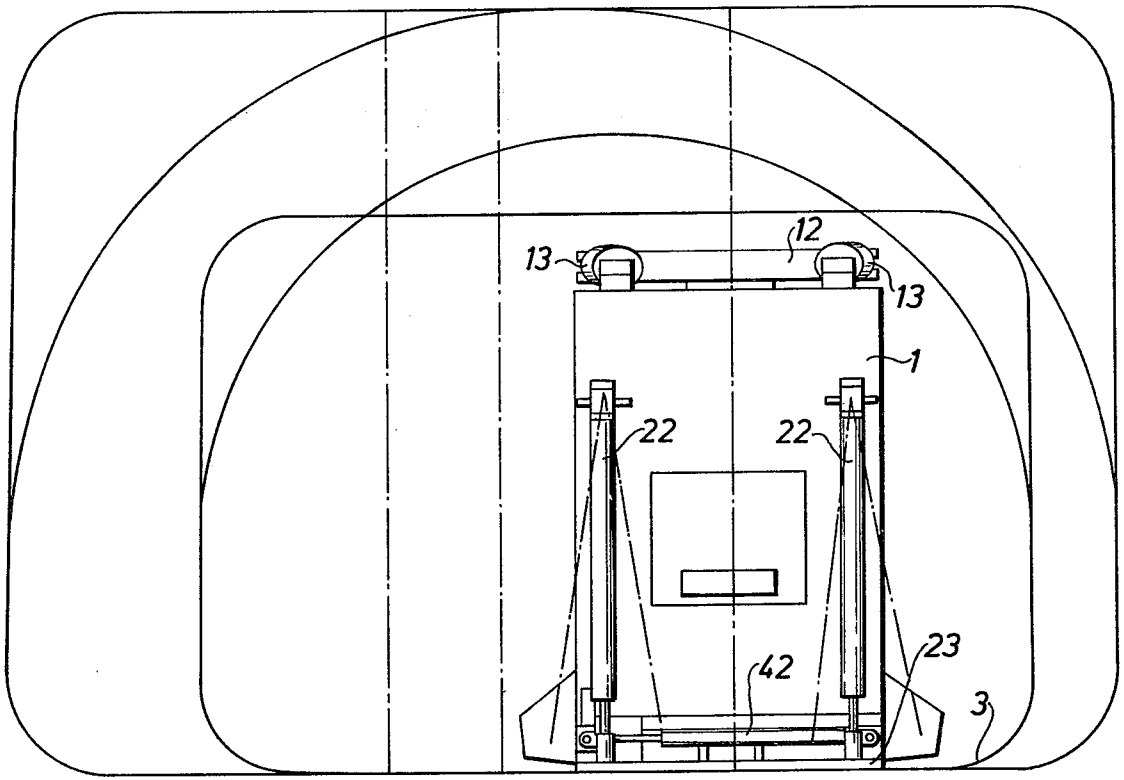
Figure 15:
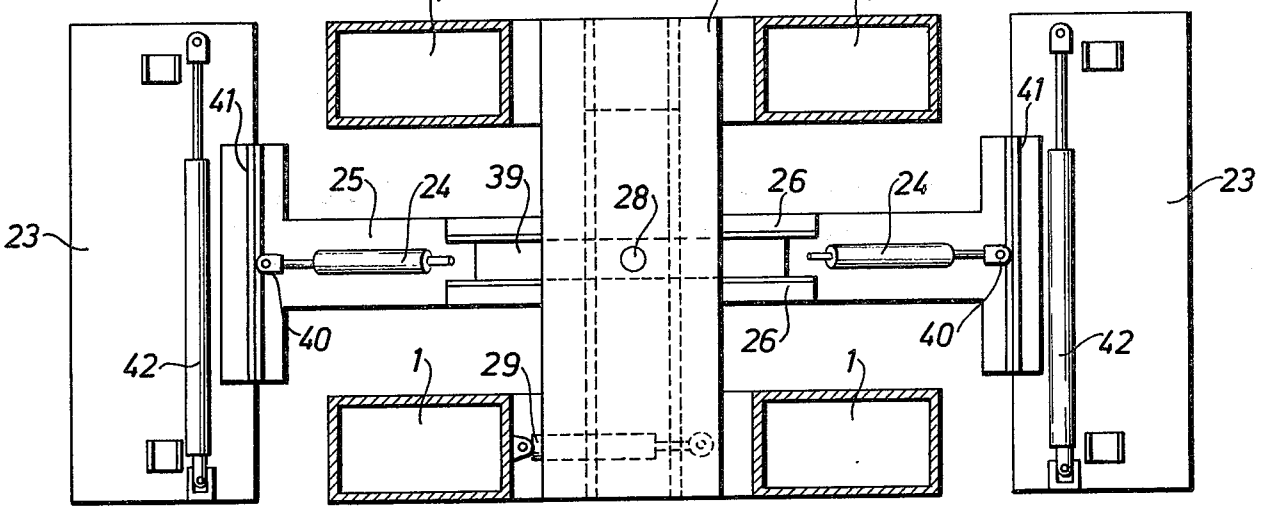
Figure 16:
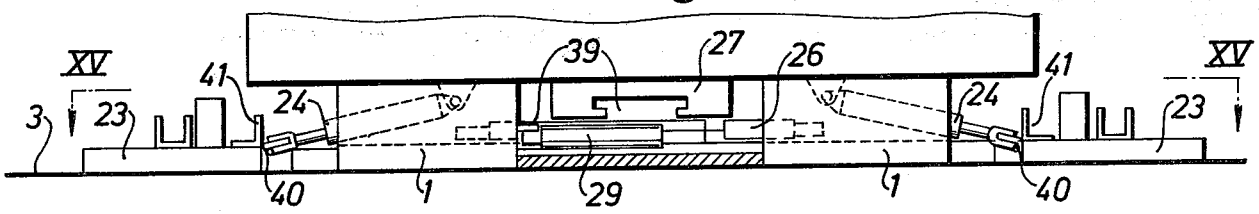
Figure 17:
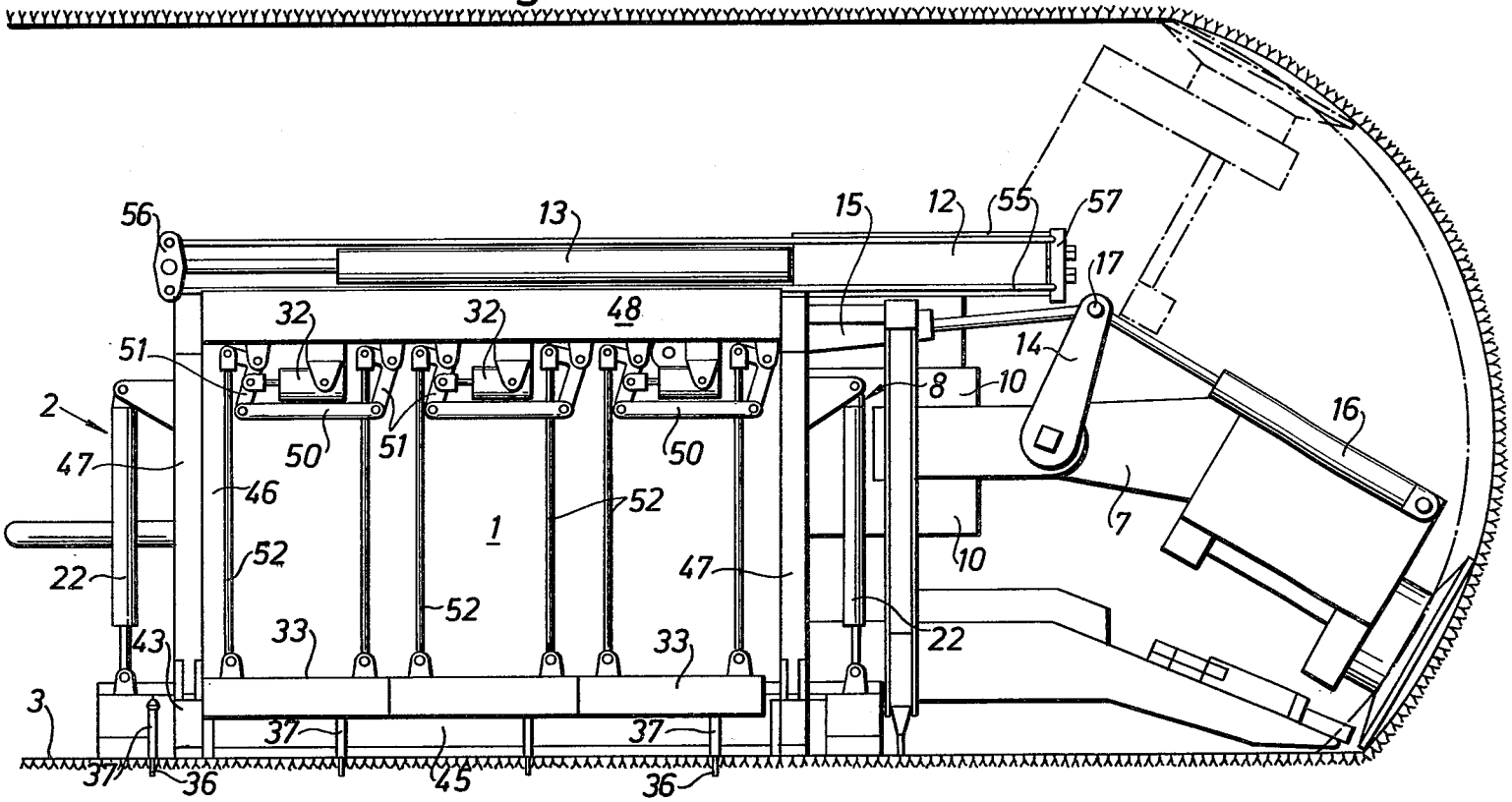
Figure 18A:
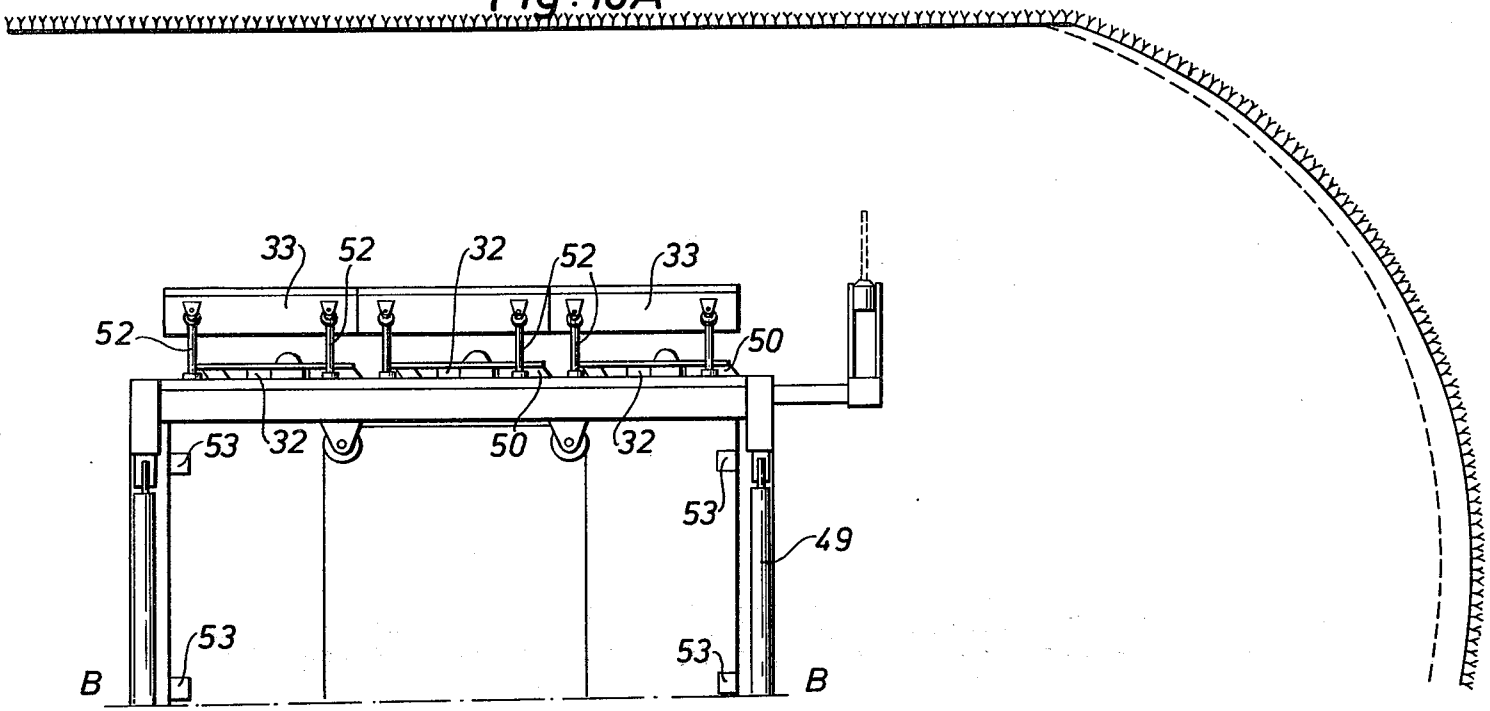
Figure 18B:
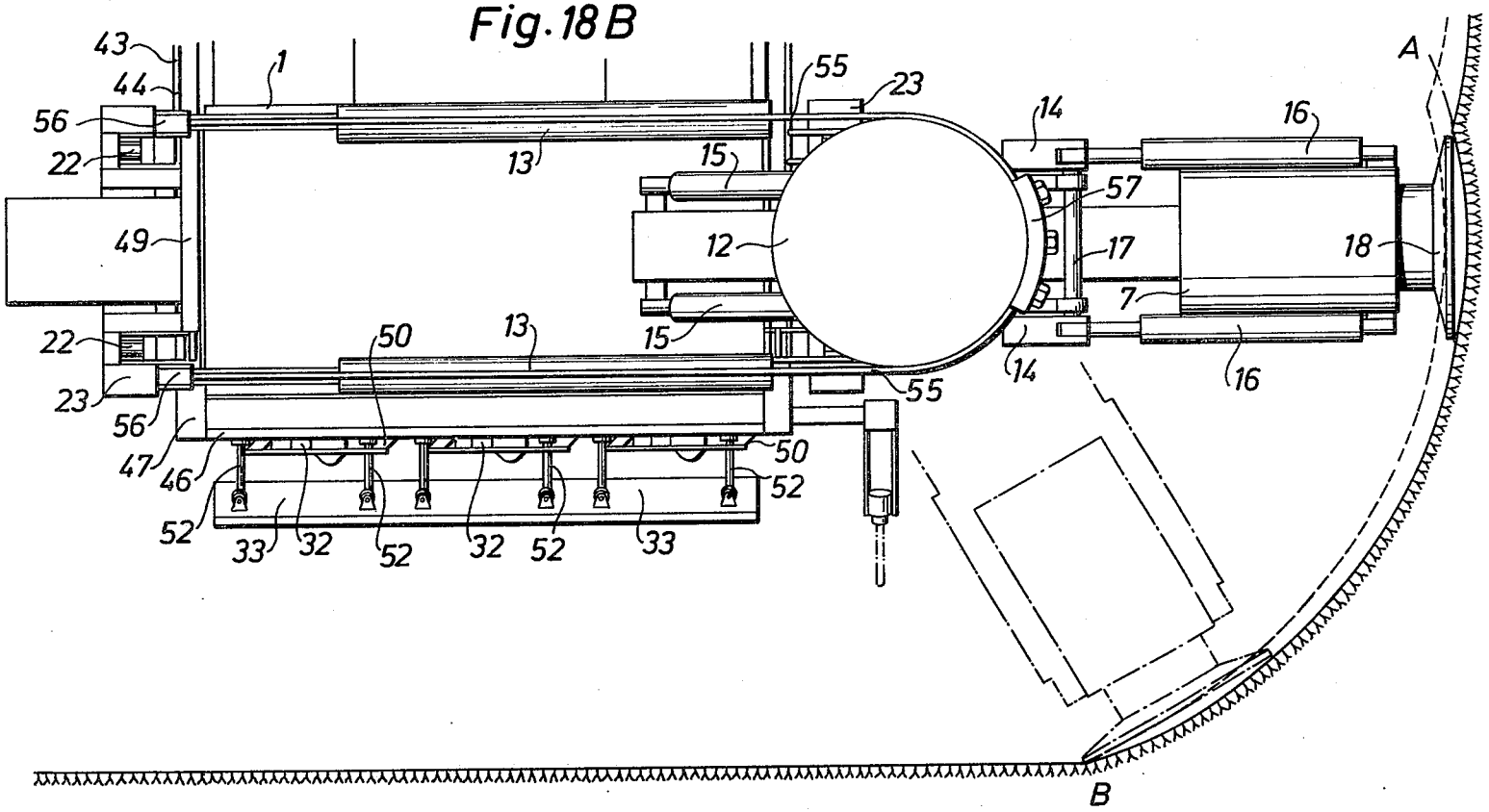
Figure 19:
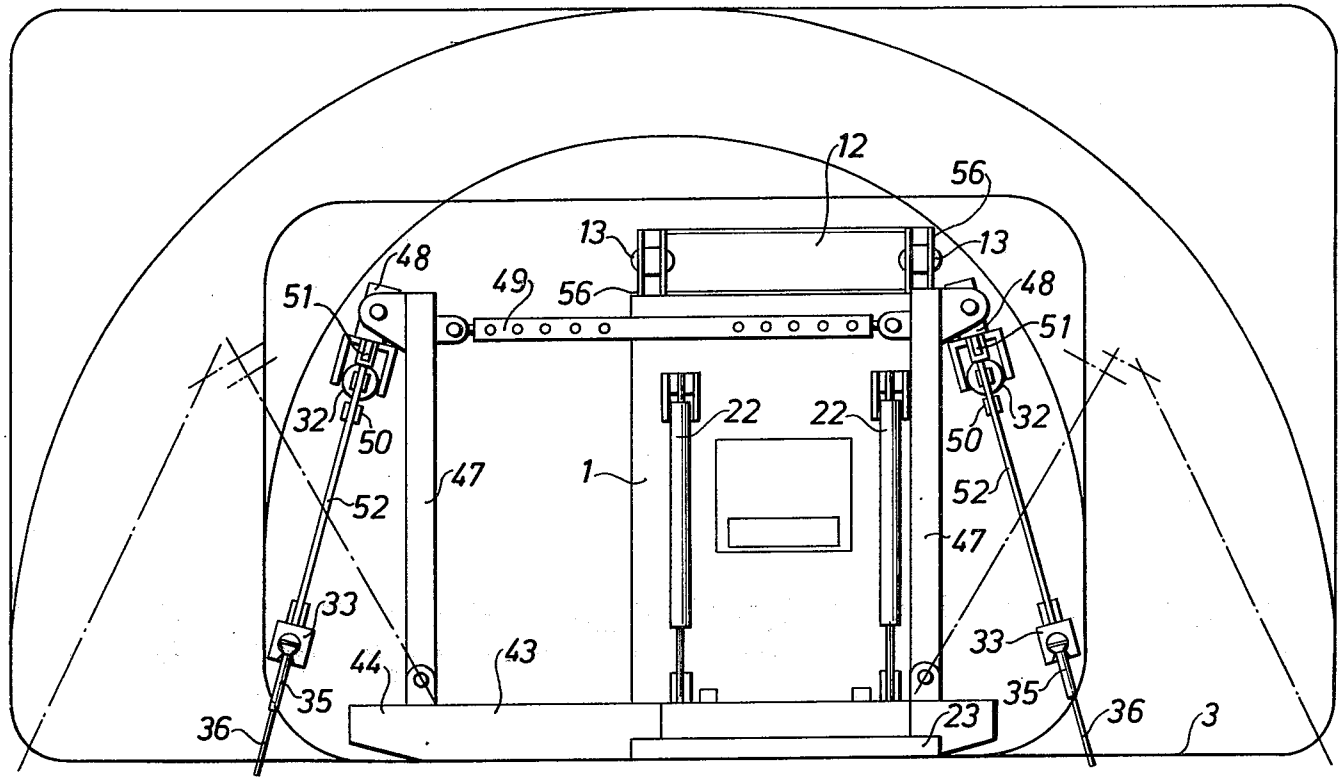
Figure 20:
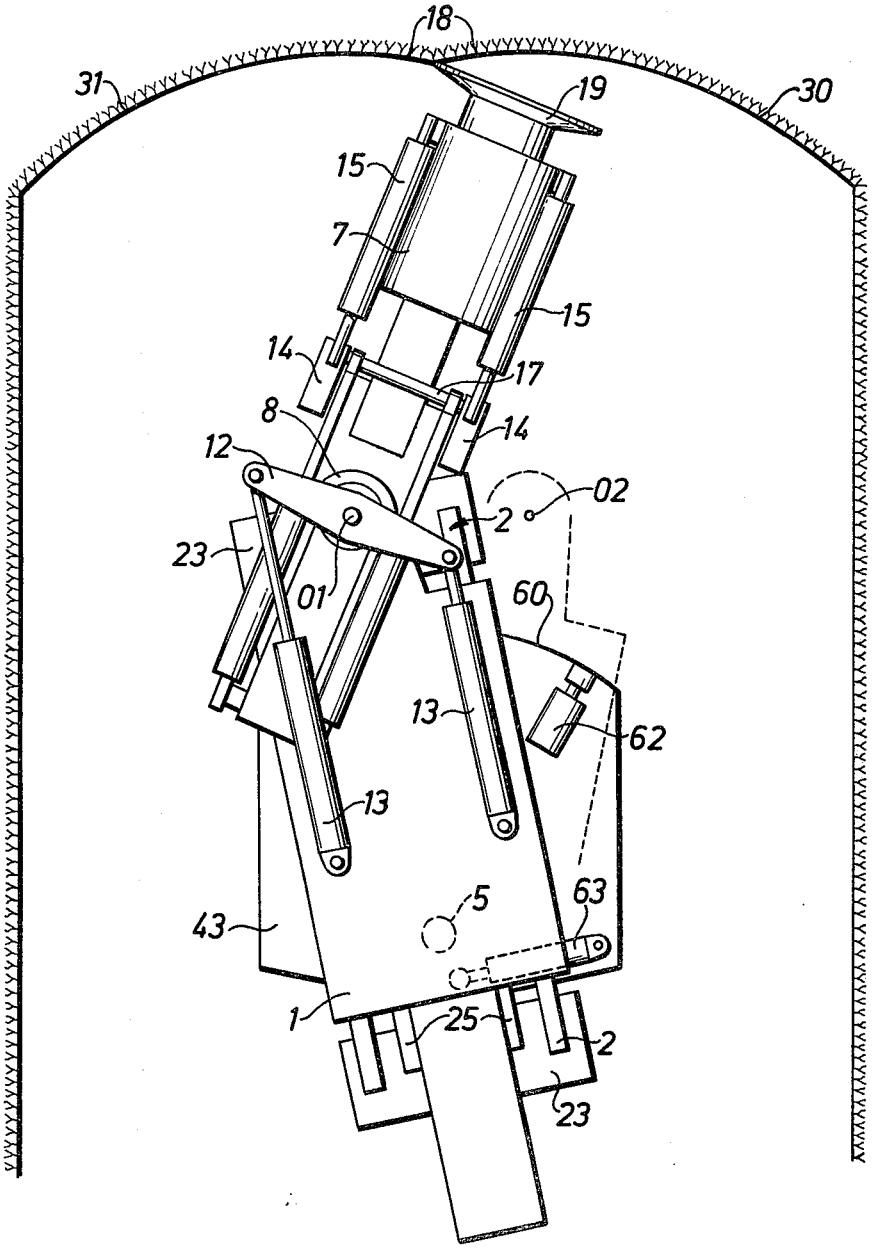
Figure 21:
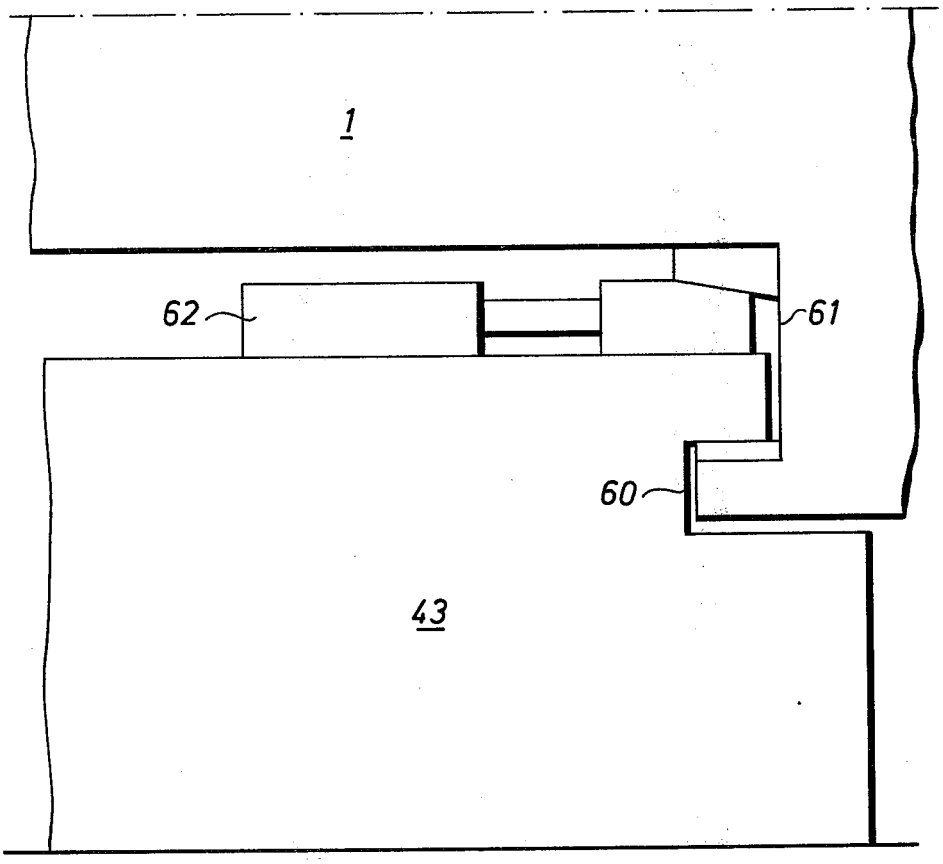
Figure 22:
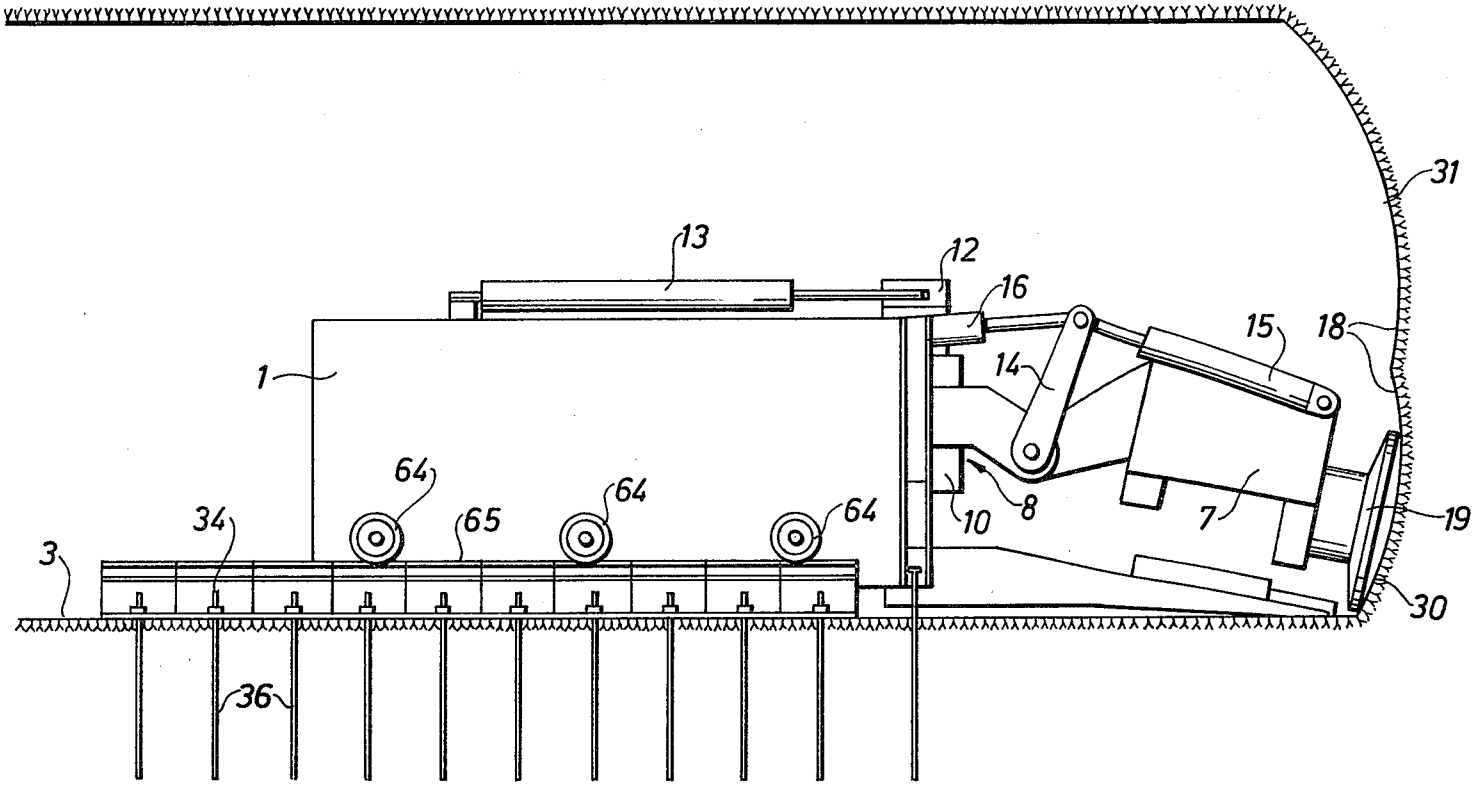
Figure 23A:
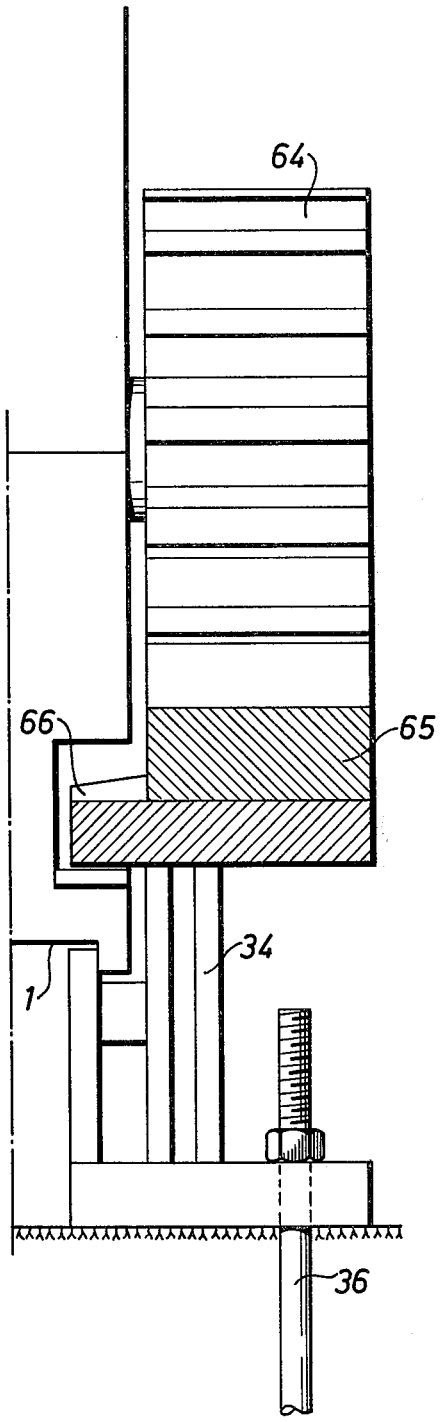
Figure 23B:
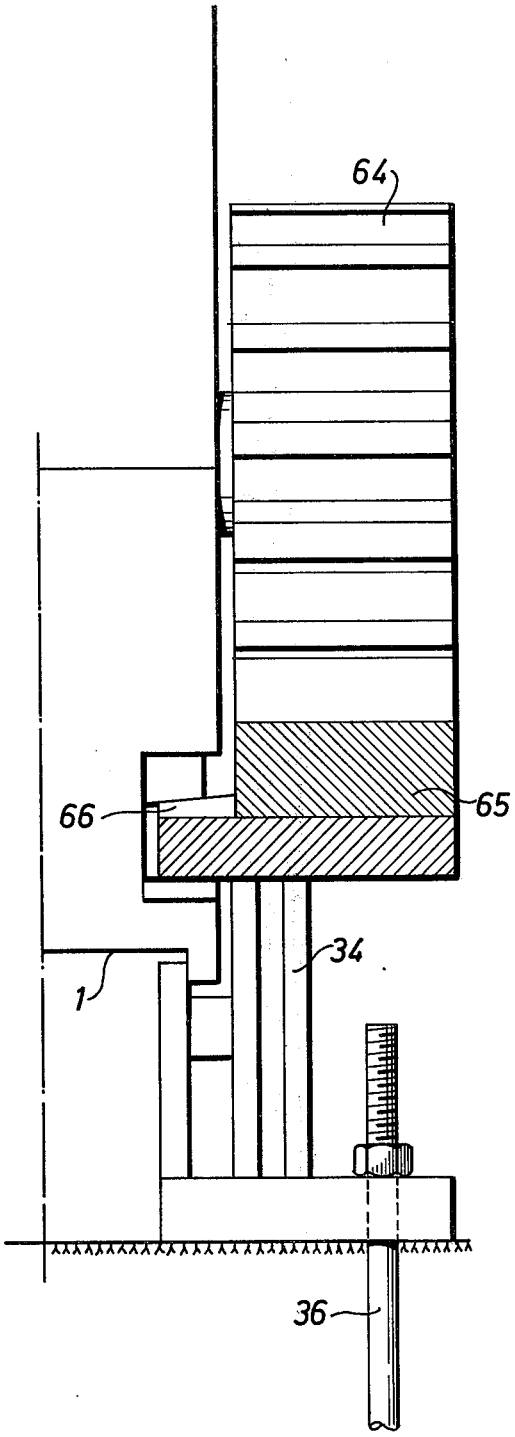
Figure 24:
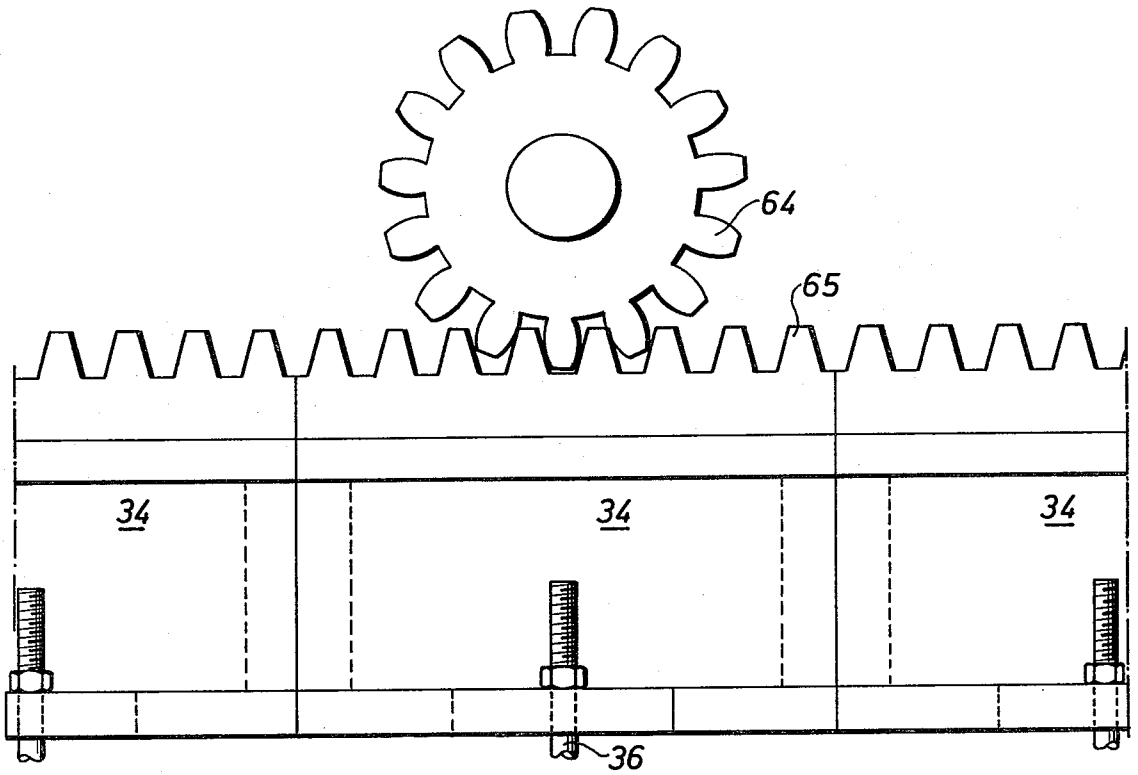
Figure 25:
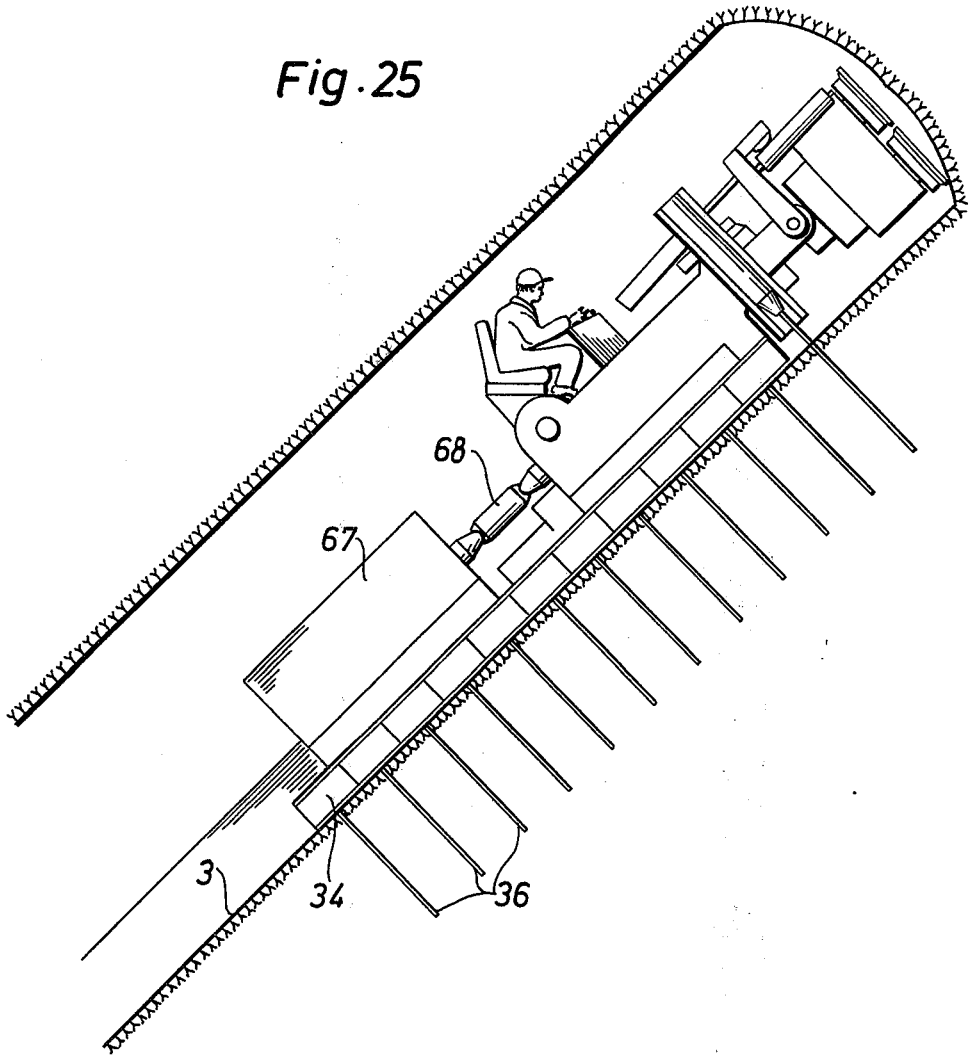
Figure 26:
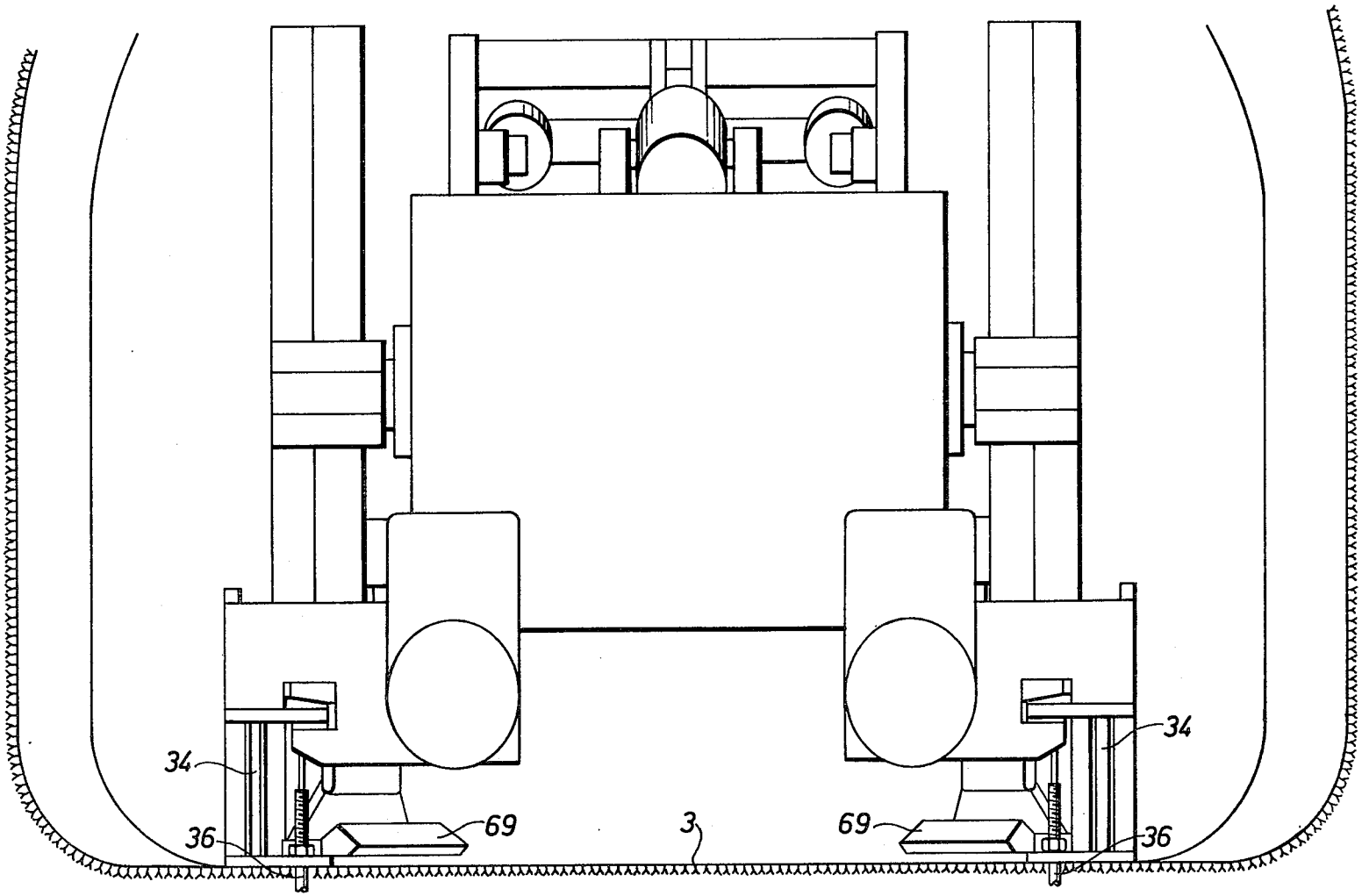
Figure 14:
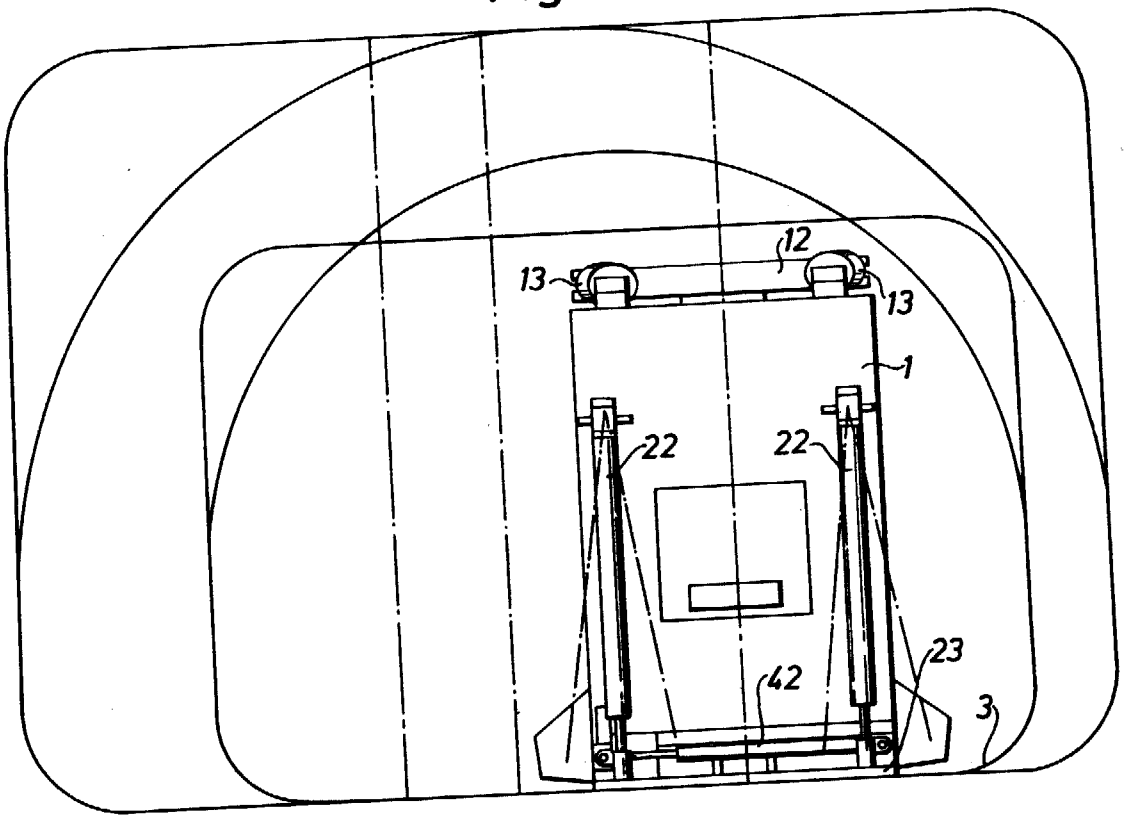
Figure 15:
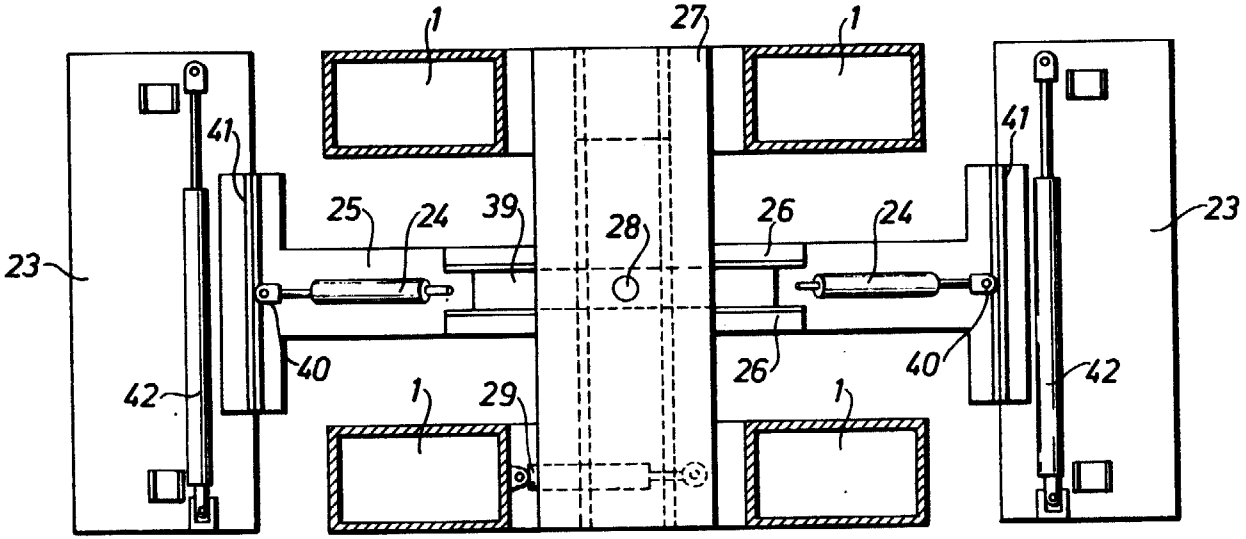
Figure 16:
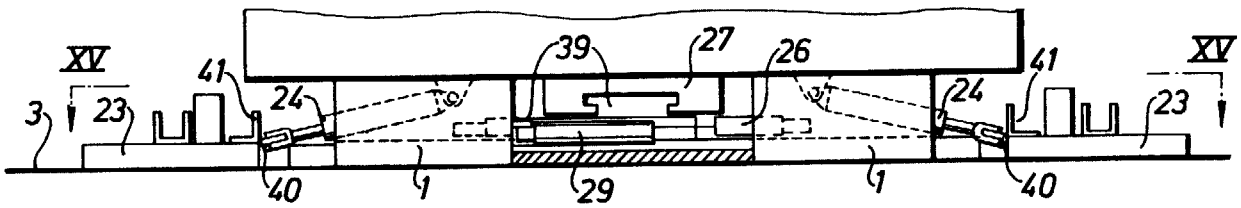
Figure 17:
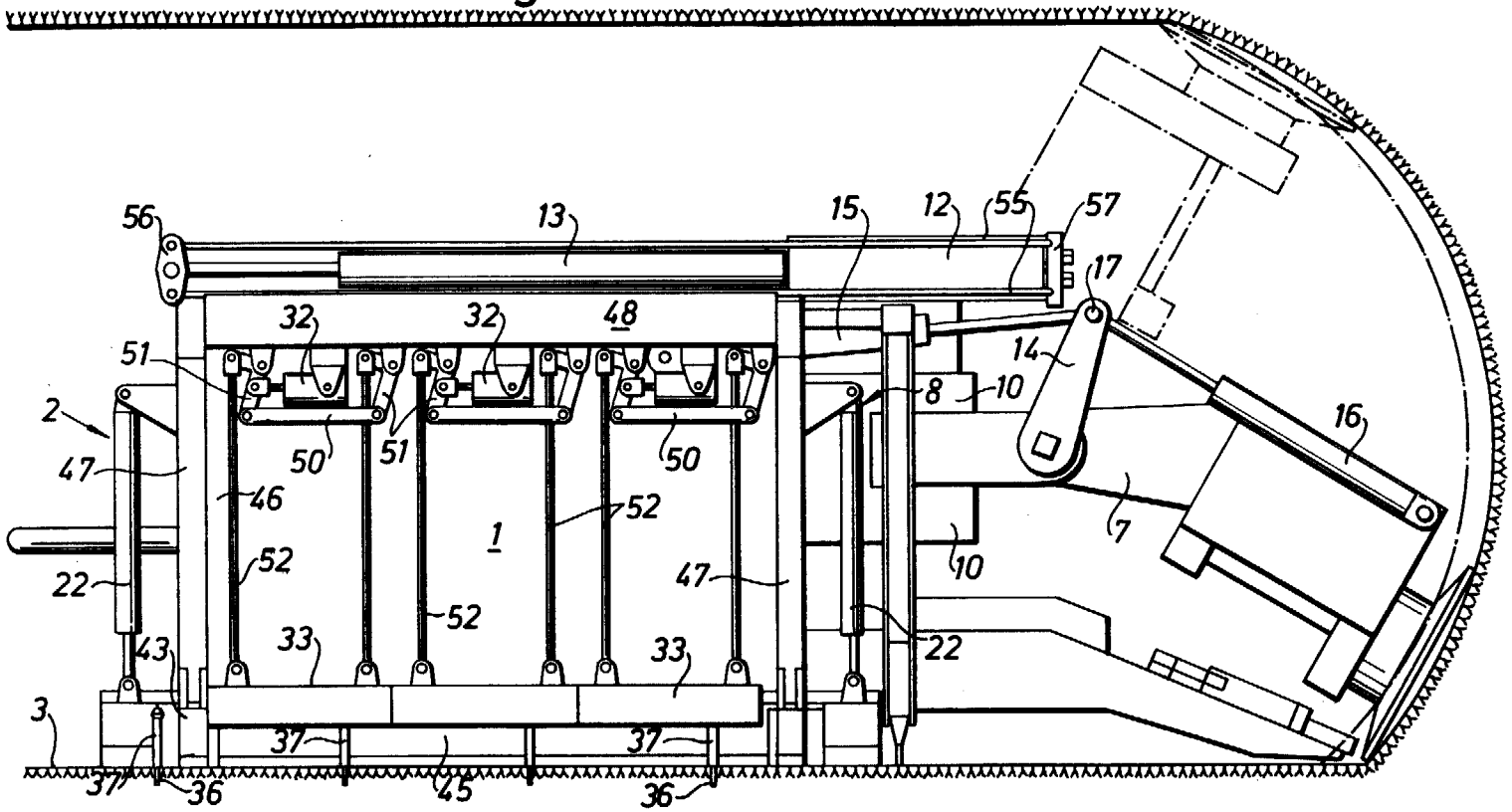
Figure 18A:
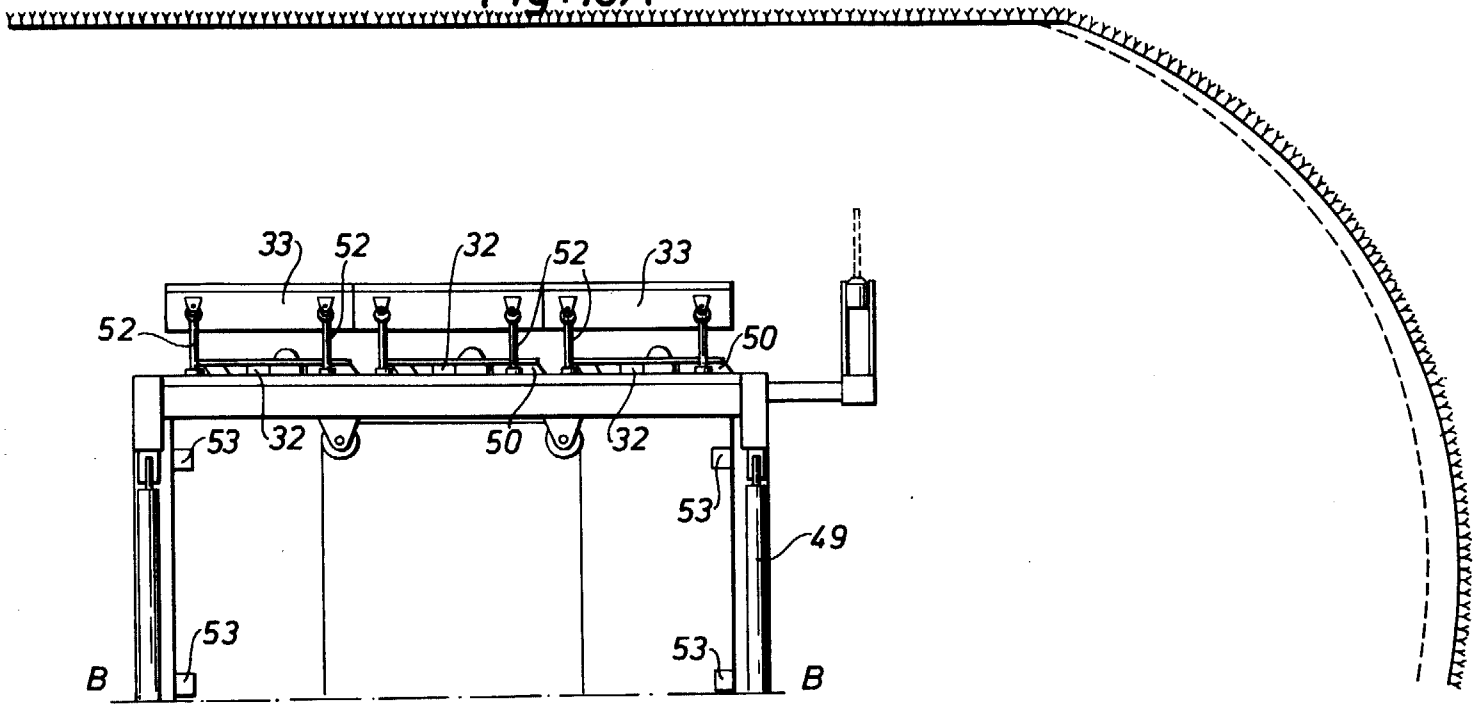
Figure 18B:
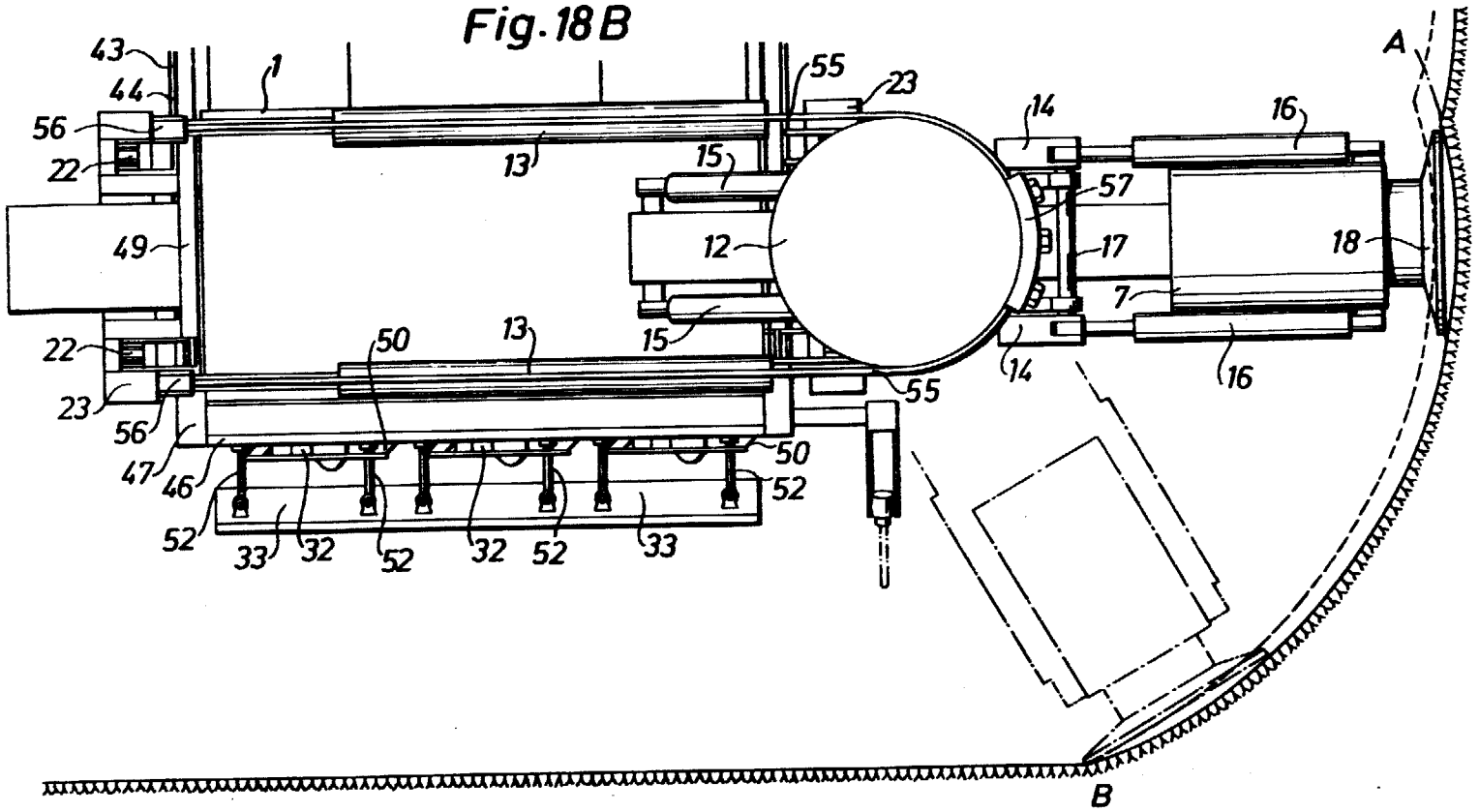
Figure 19:
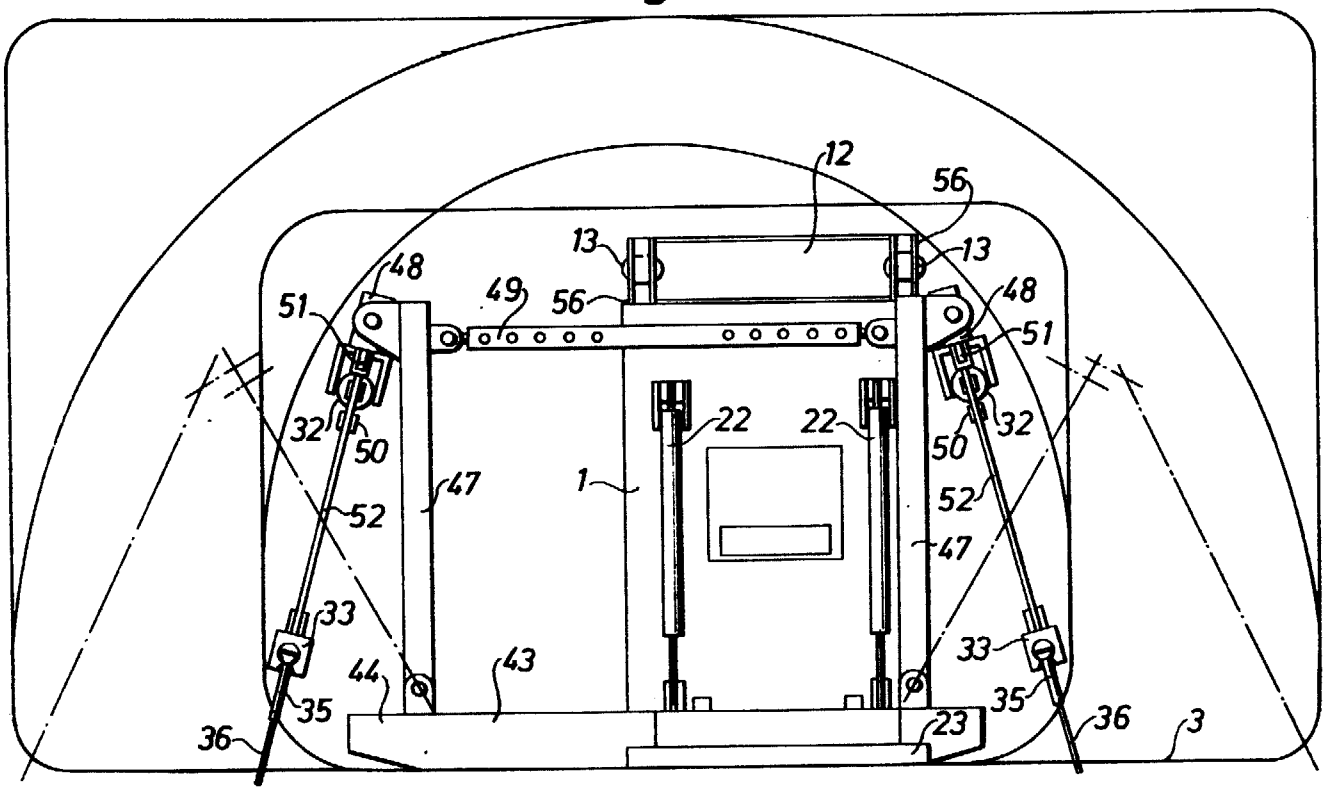
Figure 20:
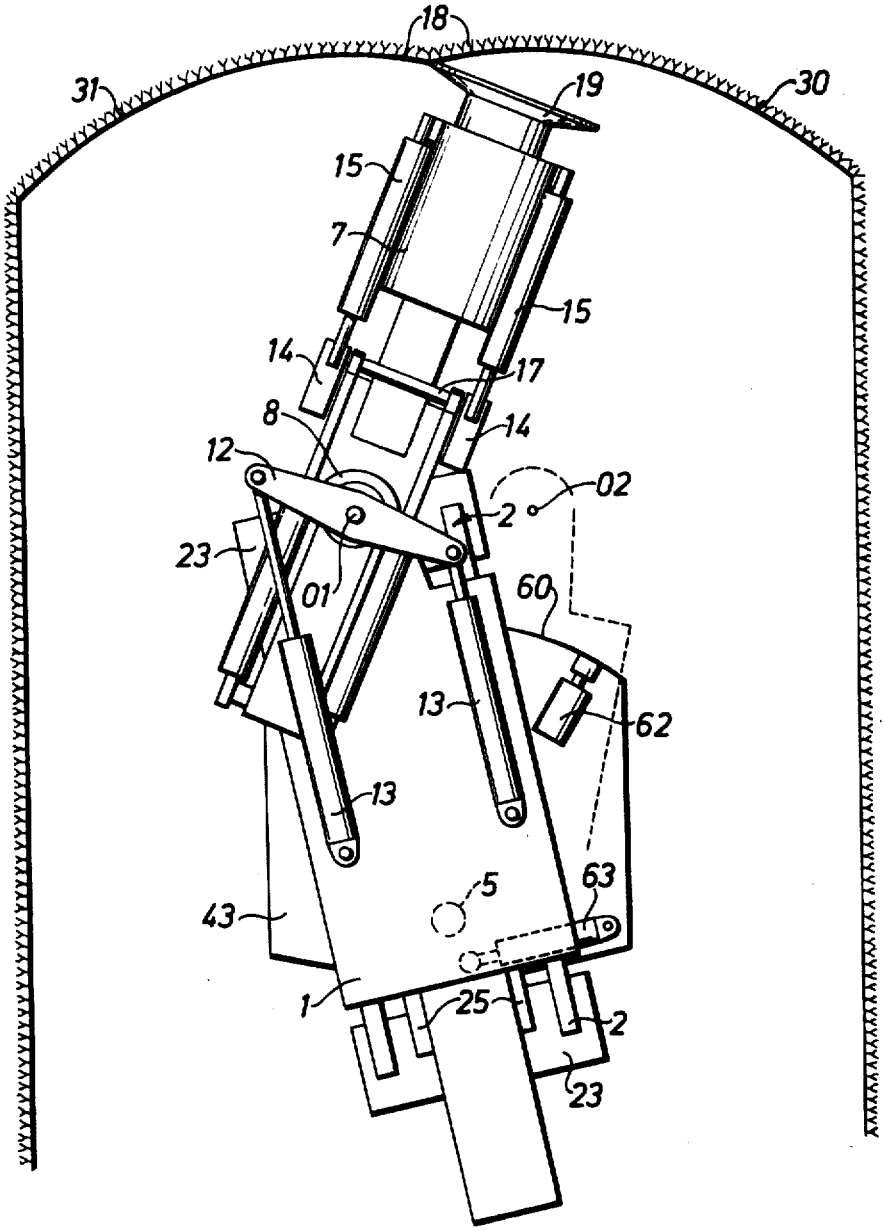
Figure 21:
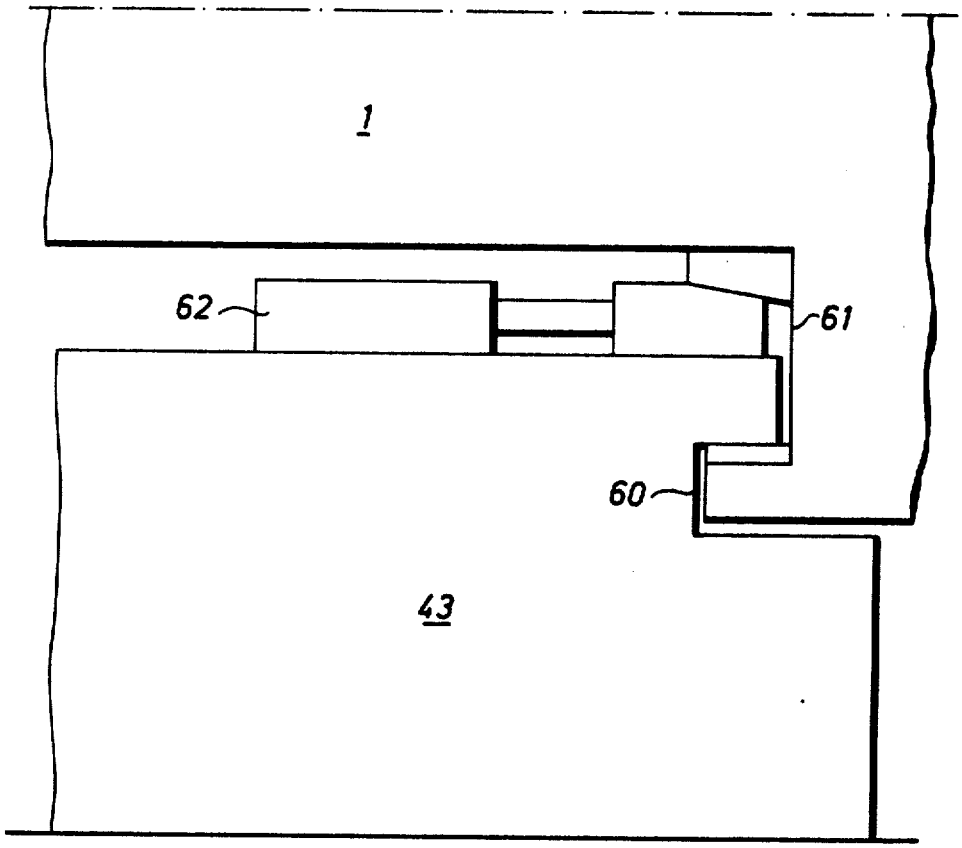
Figure 22:
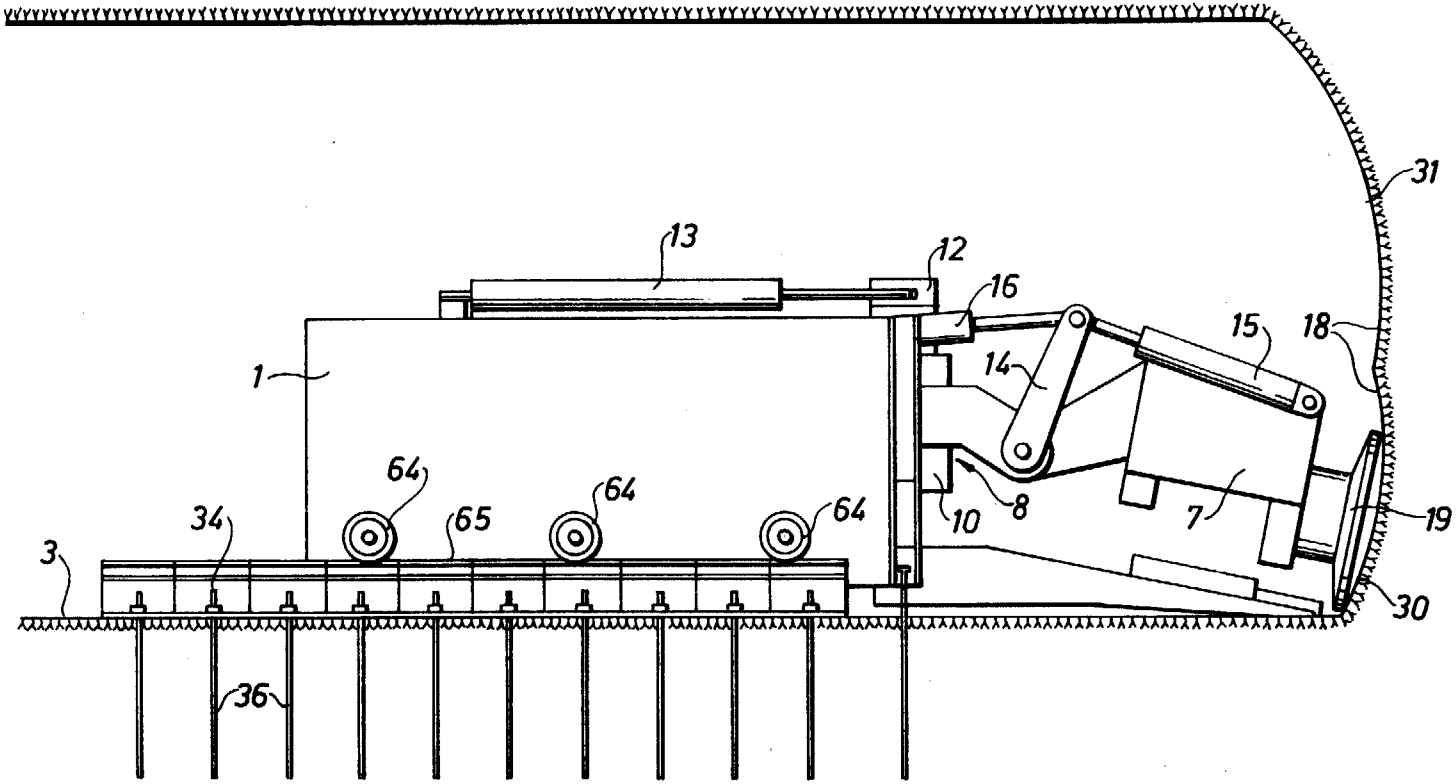
Figure 23A:
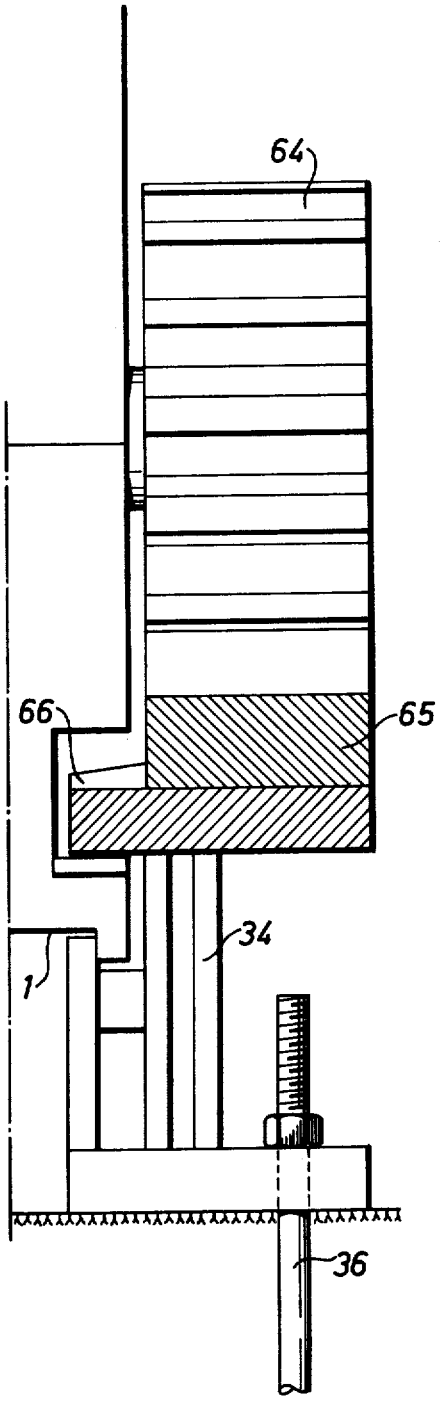
Figure 23B:
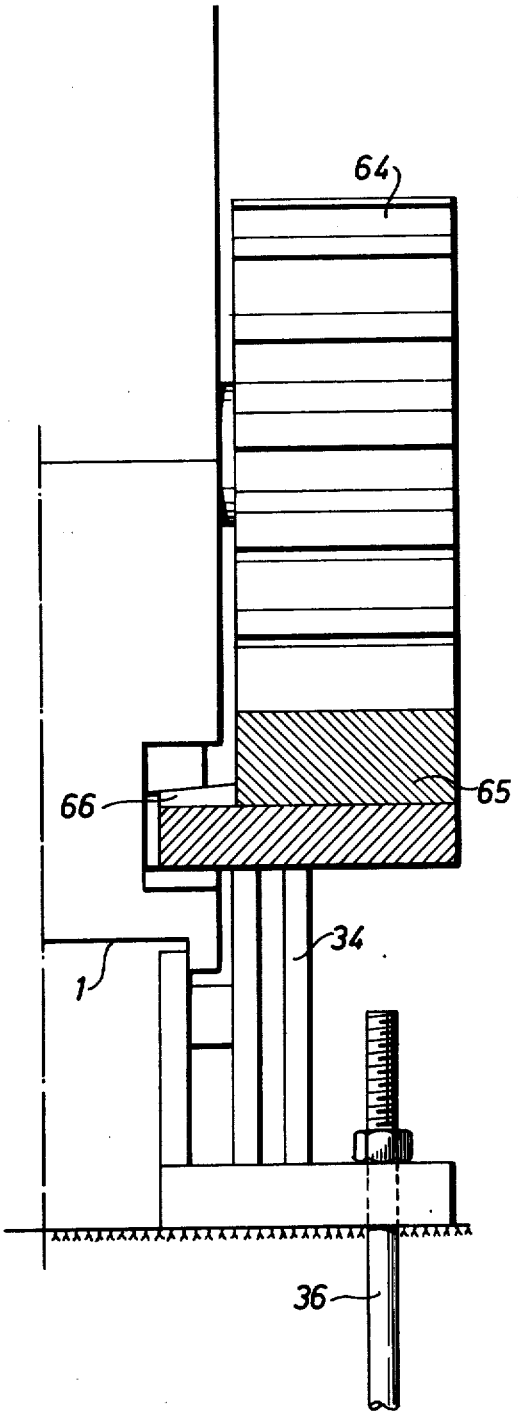

FIGS. 6(A–D) and 7(A–C) are elevational views showing the different phases of traversing movement of a frame of a machine in accordance with the invention by means of lifting jacks;

FIG. 8 is a plan view of a deflecting device for use with the machine illustrated in FIS. 1 to 4;

FIG. 9 is an elevational view of the machine illustrated in FIGS. 1 to 4 having a device for anchoring it to the floor;

FIG. 10 is a rear view of the machine illustrated in FIG. 9;

FIGS. 11A and 11B are elevational views of an alternative embodiment of a machine in accordance with the invention, showing the machine in two different positions;

FIG. 12 is an elevational view of a further embodiment of a universal arm machine in accordance with the invention;

FIG. 13 is a plan view of the machine illustrated in FIG. 12;

FIG. 14 is a rear view of the machine illustrated in FIG. 12;

FIG. 15 is a plan view (partly in section along the line XV–XV in FIG. 16) of a device for controlling the lifting jacks for displacing the machine illustrated in FIG. 12;

FIG. 16 is an end elevational view of the control system illustrated in FIG. 15;

FIG. 17 is an elevational view of another embodiment of a machine in accordance with the invention;

FIGS. 18A and 18B together constitute a plan view of the machine illustrated in FIG. 17;

FIG. 19 is a rear view of the machine illustrated in FIG. 17;

FIG. 20 is a plan view of yet another embodiment of a machine in accordance with the invention;

FIG. 21 illustrates the locking device of the machine illustrated in FIG. 20;

FIG. 22 is an elevational view of a further embodiment of a machine in accordance with the present invention;

FIGS. 23A and 23B show in profile the connections of the machine illustratedin FIG. 22 to a rail anchored to the floor in two different situations;

FIG. 24 is an elevation showing the links illustrated in FIG. 23A;

FIG. 25 is an elevational view of yet a further embodiment of a machine in accordance with the present invention, and FIG. 26 is a rear view of the machine illustrated in FIG. 25.

In the drawings like reference refer to like parts.

Referring to FIGS. 1 to 4 an excavating machine comprises a frame mounted on an arrangement 2 of lifting jacks to displace the frame over the floor 3 of a gallery in the course of excavation, the lifting jacks and an associated sleeper defining a parallelogram. A chassis 4 is pivotally connected to the frame 1 via pivots 5 around an axis transverse of the axial plane of the frame 1.

Figure 4:
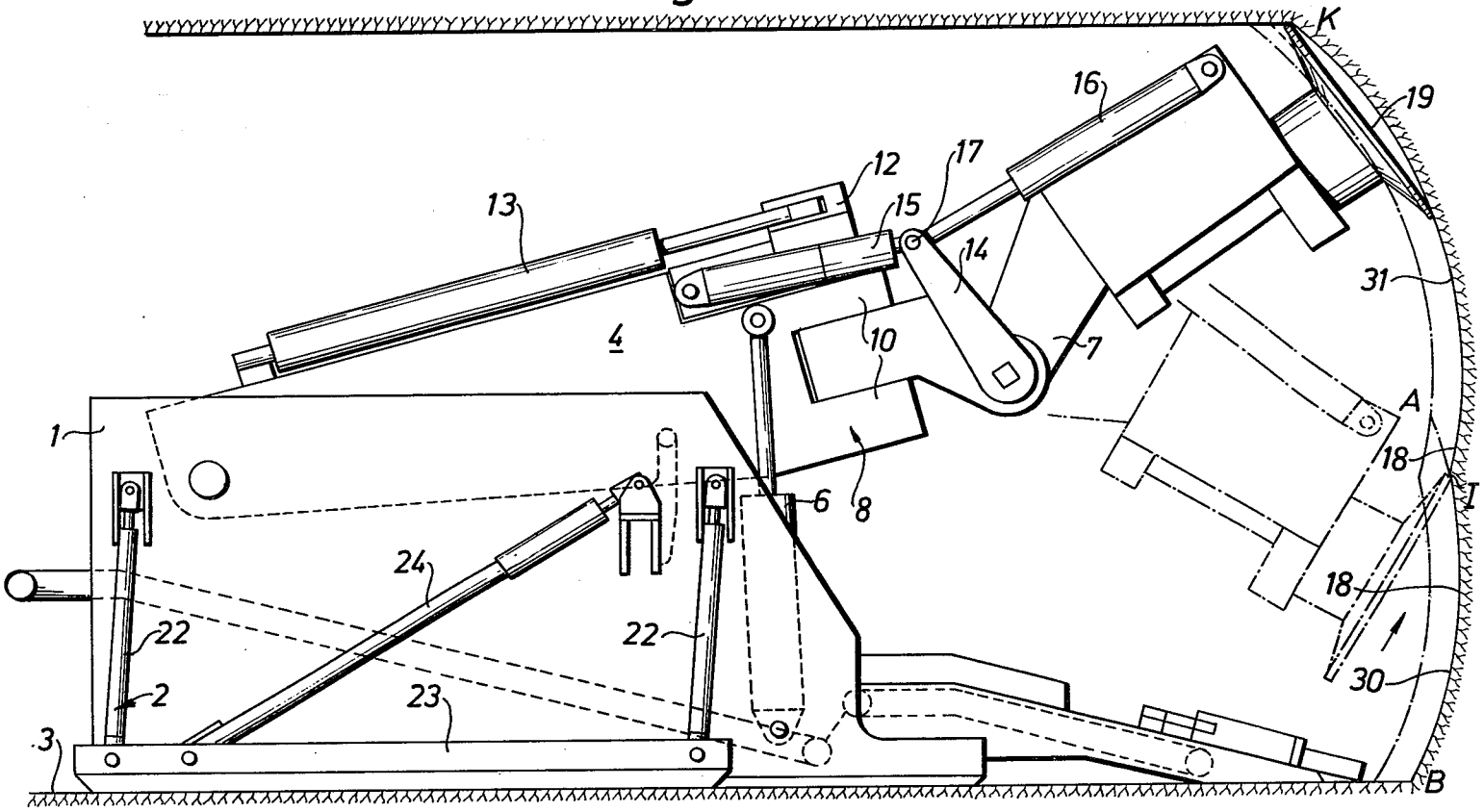
FIG. 4 is an elevational view showing the machine illustrated in FIGS. 1 to 3 with parts thereof in an alternative position.
Figure 7C:
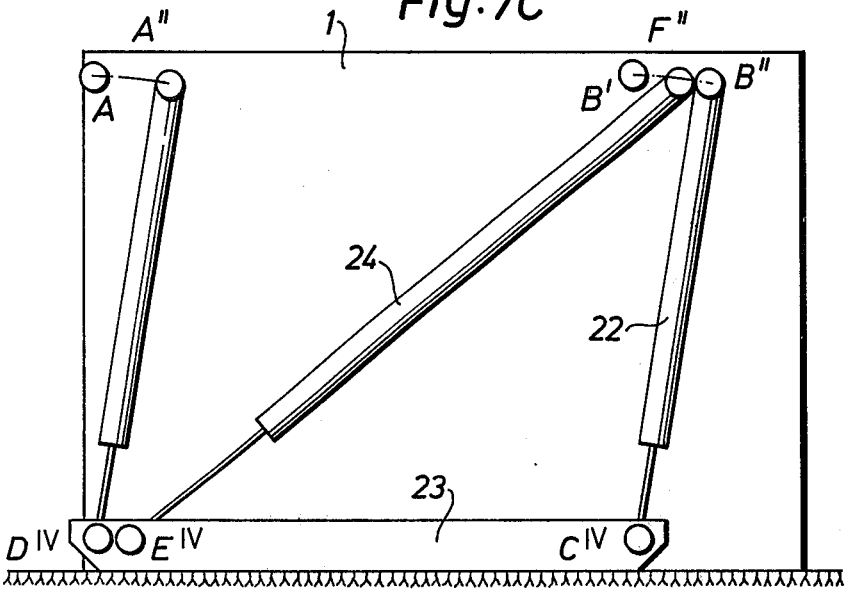

The frame 1 and the chassis 4 are also interconnected via a pair of jacks 6 adapted to pivot the chassis 4 on its pivots 5, between a bottom position (FIG. 1) and a raised position (FIG. 4). The jacks 6 also immobilise the chassis 4 in the bottom and raised positions. An arm 7 is connected to the front of the chassis 4 via a protrusion which is mounted on a pivoted connection 8 comprising a shaft 9 mounted to rotate in bearings 10 on the chassis 4, the common axis of the bearings 10 being in the axial plane of the frame 1. The bearings 10 are so located on the chassis 4 as to have their common axis substantially perpendicular to the direction of forward movement of the frame 1, when the chassis 4 is in the bottom position.

The arm 7 is pivotally connected to the protrusion mounted on pivoted connection 8 by a pivoted shaft 11 whose axis is substantially perpendicular to the axial plane of the frame 1 when the axial plane of the arm 7 and the axial plane of the frame 1 coincide. Thus the arm 7 may pivot in two directions the arm 7 being substantially rigidly secured to shaft 11. A transverse lever 12 is keyed to the shaft 9. The lever 12 is pivotally connected at its ends to the respective piston rods of two hydraulic piston jacks 13 connected to the chassis 4 so as to rotate the protrusion mounted on pivoted connection 8 and the arm 7, shaft 9 rotating in the bearings 10.

Two levers 14 are keyed to the two ends of the shaft 11. The free end of each lever 14 is pivotally connected on the one hand to a jack 15 connected to a portion of the chassis 4 adjacent the bearings 10 and on the other hand to a jack 16 pivotally connected to a portion of arm 7 adjacent the free end thereof. A cross pieced 17 interconnects the ends of the levers 14. The purpose of the assembly of jacks 15, 16 is to control pivoting the arm 7 on the shaft 11.

Figure 1:
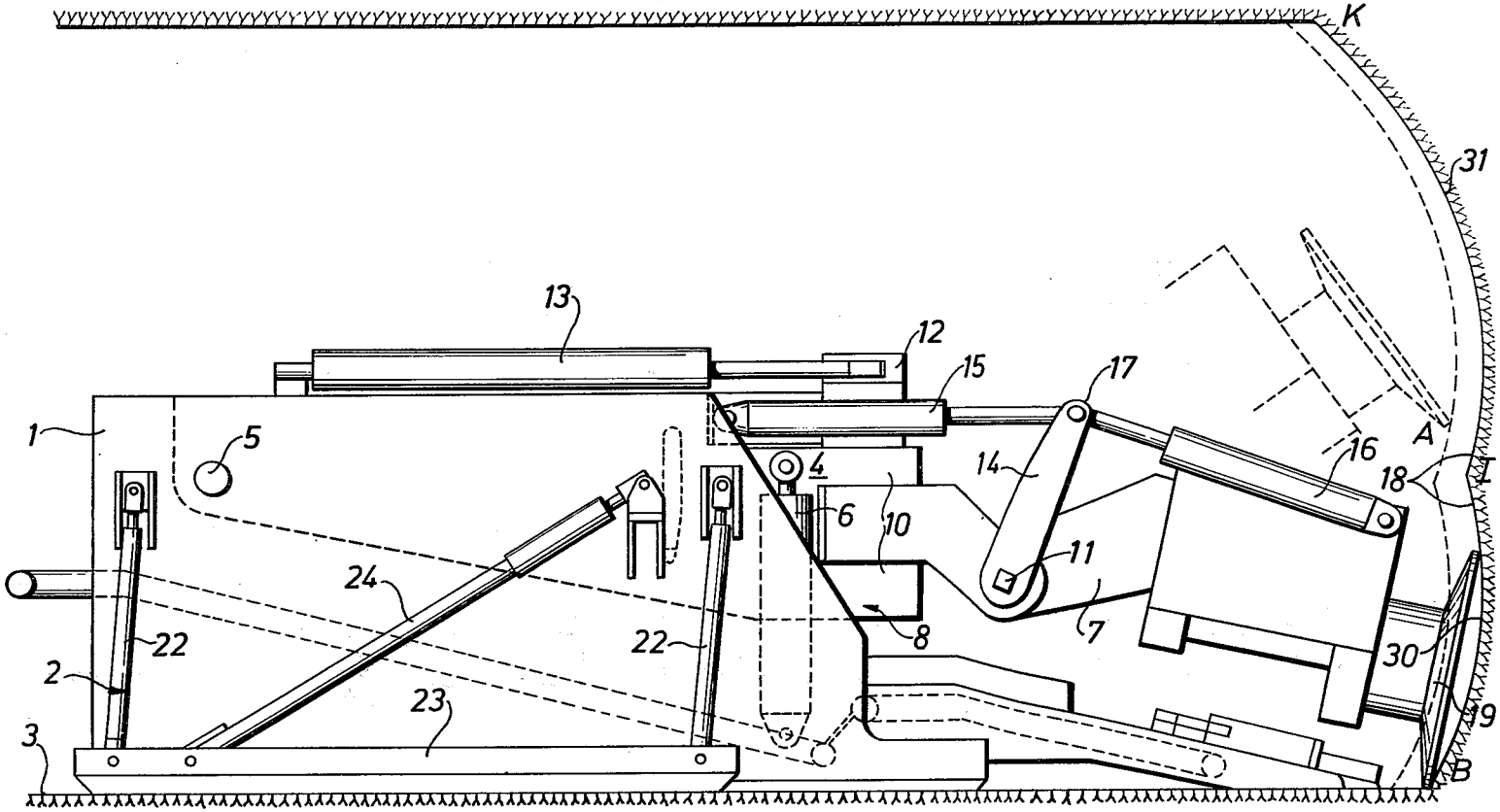
FIG. 1 is an elevational view of a first embodiment of a machine in accordance with the invention located in a gallery in the course of being excavated.

In FIG. 1 the chassis 4 is shown in a bottom position. The arm 7 is shown in continuous lines in a lower position and a portion of arm 7 is shown in chain lines in a top position.

In FIG. 4 the chassis 4 is shown in the raised position. A portion of the arm 7 is shown in chain lines in a lower position and the arm 7 is shown in continuous lines in a top position.

Figure 5:
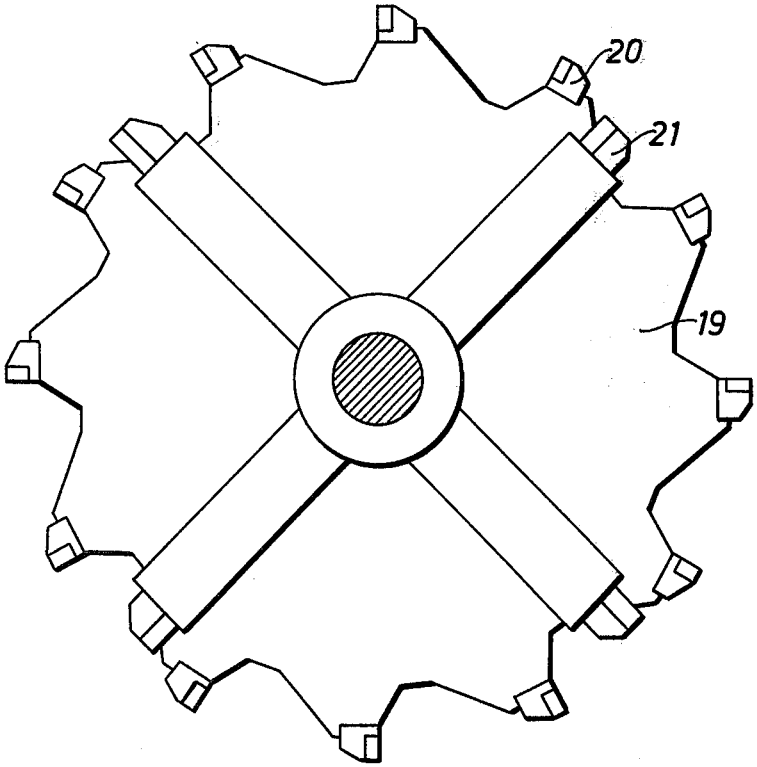
FIG. 5 is a rear view of a tool carrier for use with a machine in accordance with the invention.

At its end the arm 7 bears a rotary tool carrier 19 whose axis of rotation is substantially parallel with the arm 7. The tool carrier 19 has tools distributed over its periphery and all operating in the same plane, which is perpendicular to the axis of rotation of the tool carrier 19. The cutting tools 20 are, for instance, picks or rotary discs with cutting edges. Finishing tools 21 can also be provided located retracted radially and axially, as shown in FIG. 5. The tool carrier 19 is therefore designed to attack the excavating front 18 e.g. the exposed rock surface of the gallery semi-tagentially during the rotation of the arm 7 in the bearings 10 or on the shaft 11 and to cut from the gallery a "chip" of rock having a cross-section in the form of a complete or truncated crescent.

Two arrangements 2 of lifting jacks are pivotally connected to the sides of the frame 1. Each arrangement 2 is formed by two parallel hydraulic piston lifting jacks 22 and a sleeper 23 resting on the gallery floor. Each jack 22 is pivotally connected by its piston rod to the frame 1 by means of a universal joint and by its cylinder to the sleeper 23, also by means of a universal joint. A hydraulic piston control jack 24 disposed substantially in accordance with a diagonal of the parallelogram defined by jacks 22 and sleeper 23 is also pivotally connected by its piston rod to the frame 1 by means of a universal joint, and by its cylinder to the sleeper 23 also by means of a universal joint. Ball and socket joints can constitute the universal joints.

Referring to FIG. 8 the two sleepers 23 are rigidly interconnected via a cross-piece 25 bearing two upstanding flanges 26 defining a groove in which a lever 27, rotatably mounted on a pivot 28 attached to the bottom of the frame 1, can slide. A hydraulic piston deflecting jack 29 pivotally connected by its cylinder to the frame 1 and by its piston rod to one end of the lever 27 the rotation of the lever 27 around a pivot 28. The machine is completed by a loading device which pours the spoil on to an axial conveyor system to remove spoil from the cutting face.

To excavate a gallery using the machine illustrated in FIGS. 1 to 4, first, for instance, the chassis 4 is moved into the bottom position (FIG. 1) and the arm 7 is raised in relation to the chassis 4 into the position illustrated in chain lines in FIG. 1.

Figure 2:
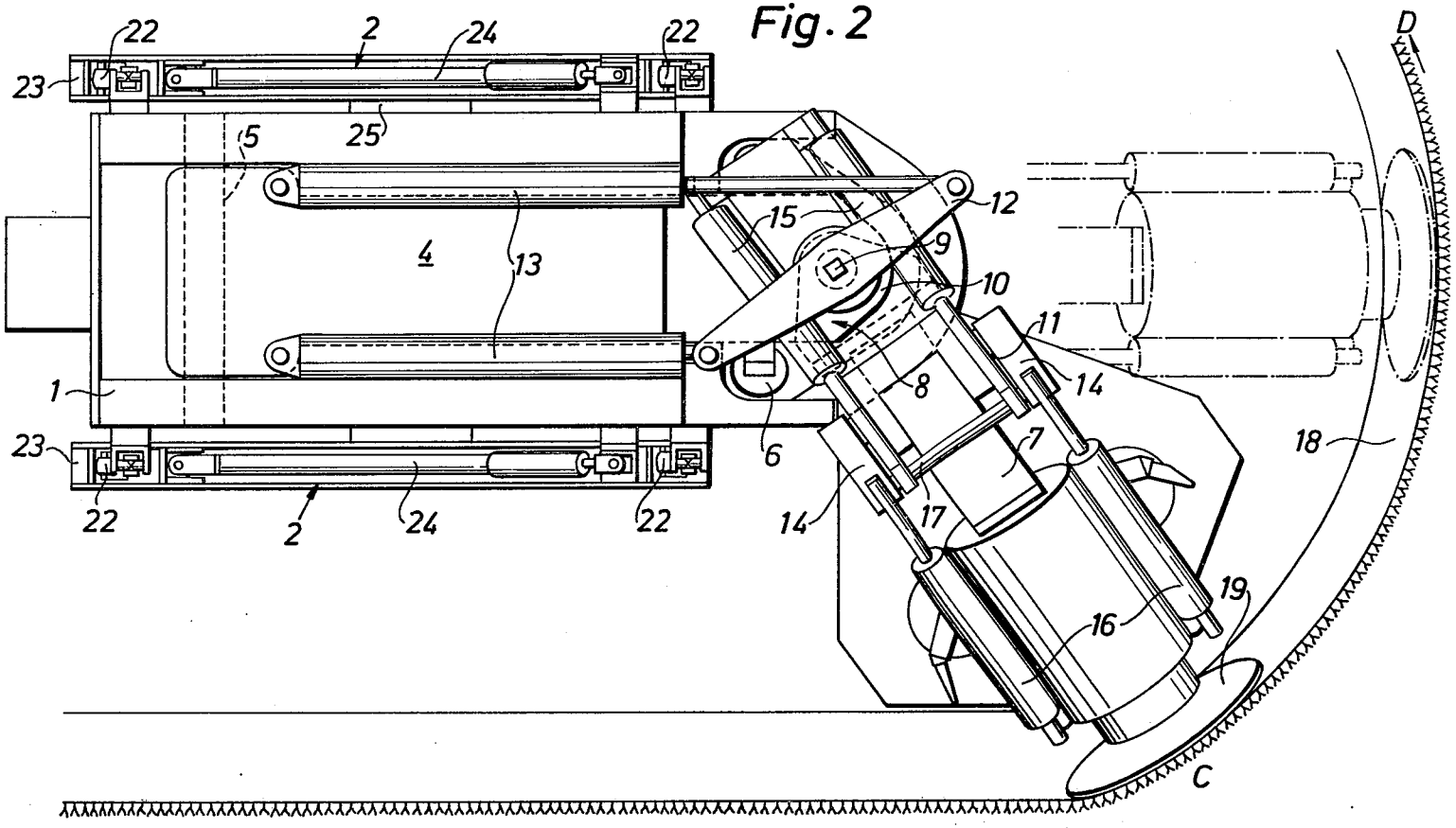
FIG. 2 is a plan view of the machine illustrated in FIG. 1.
Figure 3:
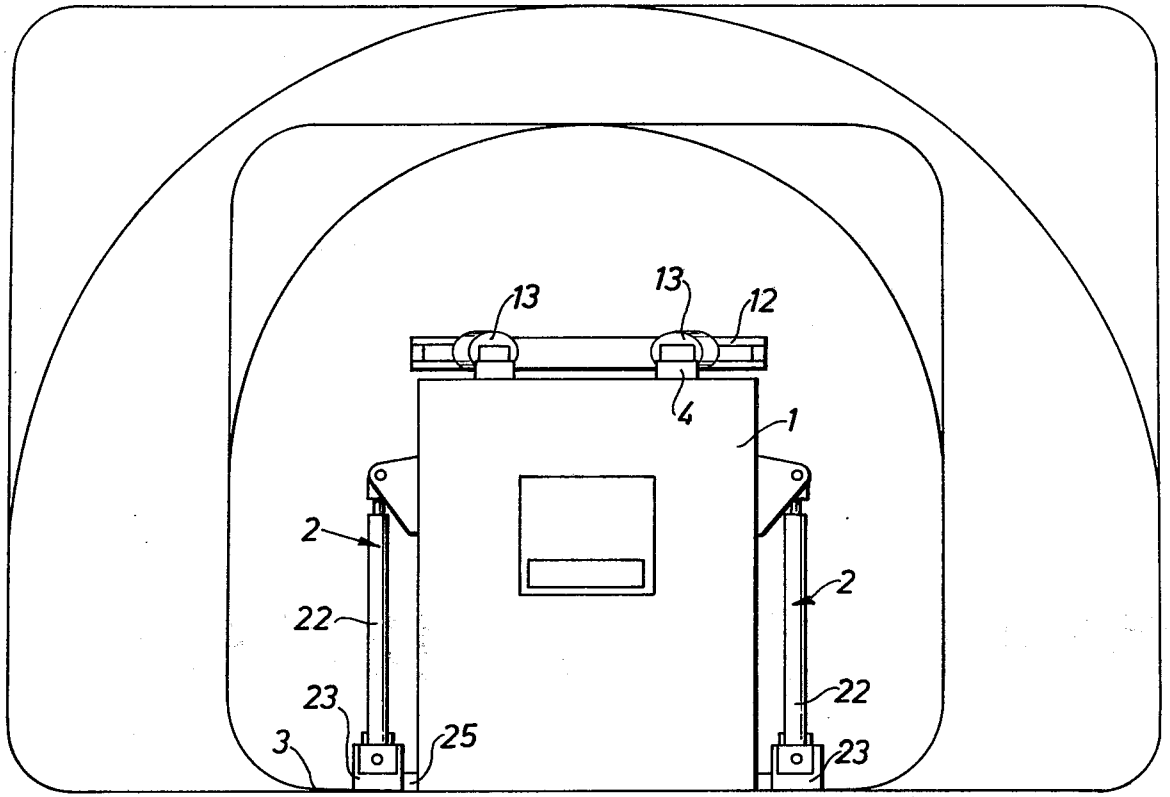
FIG. 3 is a rear view of the machine illustrated in FIG. 1.

At the same time the pivoted connection 8 can be pivoted in its bearings 10 to move the tool carrier 19 into the radial plane selected as the starting plane for cutting, for instance, into the position illustrated in chain lines in FIG. 2. Then, using the arrangements 2, the machine is advanced in the direction of the excavation front 18 to bring the tool carrier 19 into the immediate vicinity of the front 18, adjacent the point A in FIG. 1. The machine can be placed distant from a wall in this way since the tool carrier 19 is outside the sector in which it is going to operate and is therefore no obstacle to forward movement.

When the tool carrier 19 is rotating, the jack 15 and/or 16 is operated gradually to pivot the arm 7 downwards and move it, excavating as far as B, into the position shown in solid lines in FIG. 1. During this movement of the arm 7 the tool carrier 19 cuts away rock vertically from the lower part of the excavation front 18, between the points A and B in FIG. 1. Retaining the arm 7 in this bottom position, the jacks 13 are then actuated to pivot the arm 7 about the bearings 10, so that the arm 7 is displaced in the lower part of the gallery and excavation is performed from the position shown in chain lines in FIG. 2 as far as the position shown in solid lines in FIG. 2. The tool carrier 12 then moves vertically forming a cut corresponding to AB; then again the tool carrier moves horizontally forming a cut corresponding to cut CD, thus defining a truncated crescent cross-sectioned "chip" of rock which may be removed from the cutting face. Further cuts are made to provide a gallery of an appropriate width and various "chips" of rock are removed from the cutting face.

If the height AB of the vertical cutting area is greater than the diameter of the tool carrier 19, a further horizontal cut may be needed before a "chip" of rock may be removed from the cutting face. To this end the jack 15 (or 16) is actuated to lift the arm 7 by a height approximately equal to the diameter of the tool carrier 19, the jack 15 (or 16) is locked so as to retain the arm 7 at that height, then the jacks 13 are actuated as before. When the excavation of the lower part of the front 18 corresponding to AB is completed, such part of the front takes the form of a substantially spherical surface 30.

The excavation of the upper part of the front, from the point I (FIG. 4) is excavated by actuating the jack 6 so as to lift (vertically displace) the chassis 4 and place it in the position illustrated in FIG. 4, and also the jack 15 (or 16) to place the arm 7 in the bottom position shown in chain lines in FIG. 4. This placing distant from a wall can be performed since the tool carrier 19 is disposed outside the sector where it is to operate and forms no obstacle to forward movement.

The arm 7 is then pivoted around the shaft 11 to move it while excavating to the level of the crown of the gallery (position illustrated in solid lines in FIG. 4).

This operation cuts away from the upper part of the front 18 a "chip" of rock IK having a cross section in the from of a truncated crescent. From the cutting area IK, the top part of the excavation front 18 continues to be swept in the manner known from universal arm machines. The finishing tools are used, more particularly along the side walls of the gallery to provide the side walls with a smooth finish.

The method of operation described hereinbefore, selected for facility of explanation, is given merely by way of example. Other methods could be used and the order of cuts adopted could be different. Inter alia advantageously cutting can be performed in an extreme radial plane, by placing the arm 7 in the position illustrated in solid lines in FIG. 2.

When the excavation corresponding to IK is completed, the machine is advanced by one step. The upper part of the front 18 takes the form of a substantially spherical surface 31. The lower surface 30 and the upper surface 31 intersect one another along the horizontal line which crosses the axial plane of the gallery at the place I. The different orientation of the two surfaces 30, 31, described starting from different centres, enables excavation passes to be started from the line of intersection of such surfaces, and no longer from a side wall of the gallery, since the shape of the front now allows the tool carrier to be retracted outside the sector where it is to operate and then be advanced by one step, without forming an obstacle to such forward movement.

Excavating passes therefore need no longer be started from adjacent the edge of crescent shaped "chip"; this means that on the one hand the size and shape of the gallery can be more precisely selected, and on the other that the cutting of "chips" in the shape of truncated crescents obviate the tapering ends of the crescents where rock production is low, since the proportion of rock destroyed at that point is high.

The advancing movement of the machine is generally forward (to the right in FIGS. 1 and 4) into the face of the gallery which is being cut. This direction of movement may be referred to below as an advance in a forward movement generally along an axis in the direction of excavation. The lifting of the chassis 4, and the consequent lifting of the shaft 11, as described immediately above with particular reference to FIG. 4, may be referred to as a displacement transverse to the axis in the direction of excavation, since it is generally transverse to that axis rather than parallel to the axis. Thus, the shaft 11 is operable in two different positions respectively illustrated in FIGS. 1 and 4 which have different transverse displacements with respect to the axis in the direction of excavation. Thus, excavation is provided at two different ranges of transverse displacement represented respectively by the cuts at sectors AB and KI. The transverse displacement described above is a vertical transverse displacement. Horizontal transverse displacement may also be provided as disclosed below in connection with other embodiments.

The stepped advancing movement of the machine illustrated in FIGS. 1 to 4 is performed by means of the arrangements of jacks 2 in the following manner.

Figure 6A:
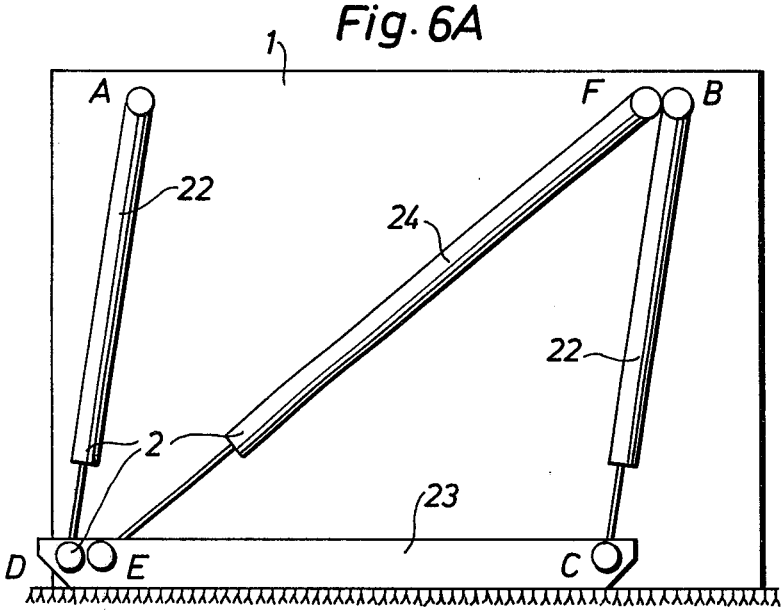
Figure 6B:
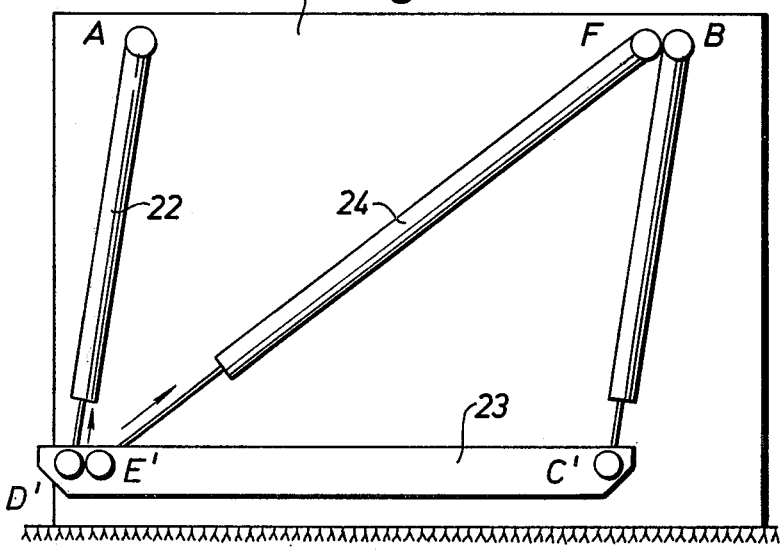
Figure 6C:
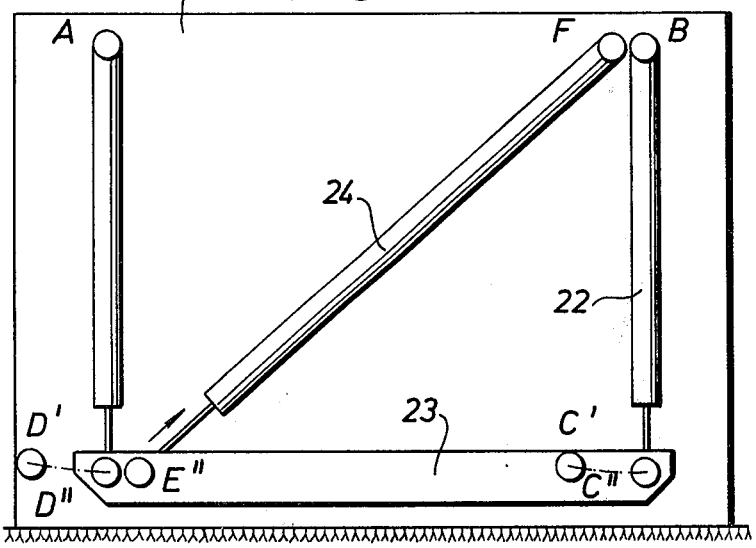
Figure 6D:
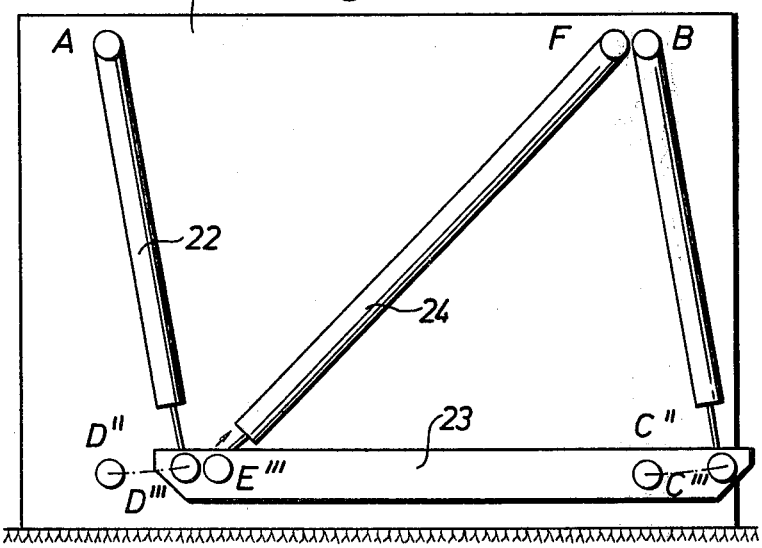
Figure 7A:
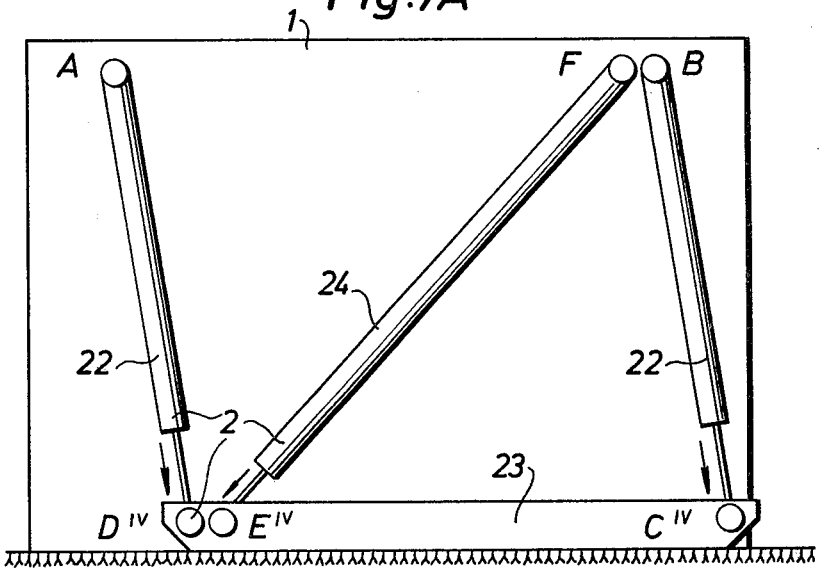
Figure 7B:
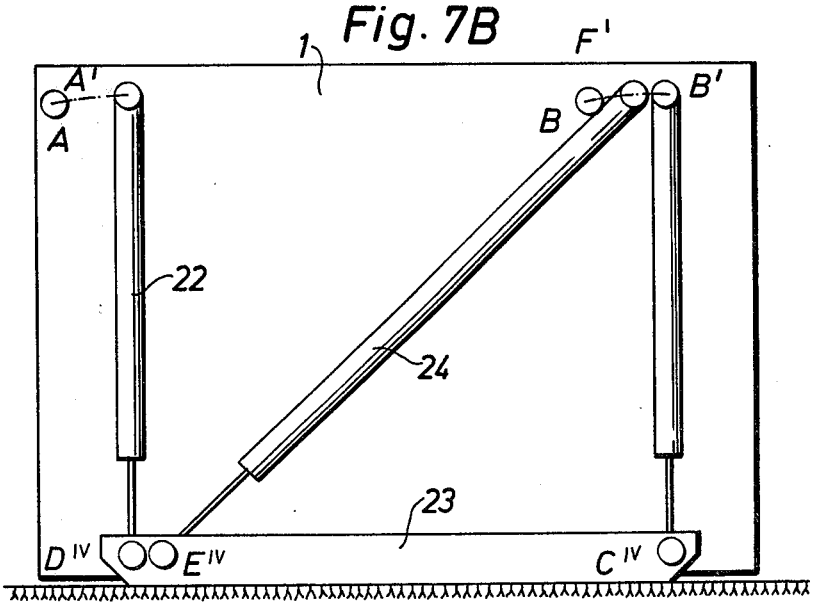

Let us suppose the arrangements 2 are in the starting position illustrated in FIG. 6A — i.e., with the sleepers 23 on the floor and towards the rear of the machine. The lifting jacks 22 slightly raise the sleepers 23, while the deforming jacks 24 are retracted (6B). The jacks 22 are then locked, the jacks 24 continue to be retracted until the sleepers 23 have advanced by one step (FIGS. 6C and 6D). Then, as shown in FIG. 7A, the jacks 24 are extended while the jacks 22 deposit the sleepers 23 on the gallery floor. Then, as shown in FIGS. 7B and C, the jacks 22 remaining locked, the jacks 24 are extended to deform the arrangement 2 of jacks again and, this time the jacks bear against the sleepers 23; and the frame 1 is pivoted on the jacks 22, being raised slightly and, finally being deposited on the gallery floor. The frame 1 has then been advanced by one step.

To change the direction followed by the machine, the sleepers 23 are raised by the jacks 22, 24, while at the same time the deflecting jack 29 is operated in the required direction until it has orientated the lever 27, rotating it around the pivot 28, to lie in the intended direction of advance of the machine. In its rotation the lever 27 entrains the two flanges 26, the cross-piece 25 and the sleepers 23, which remain constantly parallel with the lever 27. The jack 29 is locked, while the jacks 22, 24 deposit the sleepers 23 on the floor which are therefore orientated to lie in the intended direction of advance of the machine. Then the jacks 22, 24 bear against the sleepers 23 to raise the frame 1 slightly, while the jack 29 is reversed to return lever 27 to its initial position and thus return the frame to a position parallel with the sleepers 23. The jack 29 is then again locked and the jacks 22, 24 deposit the frame 1 on the floor.

During the lifting of the frame 1, the lever 27, connected to the frame 1, is displaced vertically between flanges 26 whose height is such that the lever 27 cannot escape from the groove defined between them. The deflecting operation can be performed at the same time as the advancing or withdrawing operation.

When the machine illustrated in FIGS. 1 to 4 is excavating hard rocks, its weight is inadequate to immobilize it during operation and further anchoring devices becomes necessary.

The device for anchoring a machine to the floor illustrated in FIGS. 9 and 10 comprises a number of anchoring jacks 32 pivotally connected to each of the sides of the frame 1. Pivotally connected to the ends of the piston rods of the jacks are jaws 33 which engage with the flanges of rails 34. The rails 34 are attached to the heads of sleeves 35 which in turn are screwed to rods 36 which are firmly secured to the gallery floor 3. The jacks 32 operate in the same plane as the rods 36 and are parallel therewith, the rods 36 not being vertical but being inwardly inclined, as can be seen from FIG. 10. While the machine is displaced by its arrangements of jacks 2, the jacks 32 are released and do not hinder movement of the machine. The jaws 33 slide on the rails 34.

As soon as the machine is immobilized, the anchoring jacks 32 exert a pull on the jaws 33 which act on the lower part of the flanges of the rails 34 and the latter are retained in position by the rods 36. The action of the jacks 32 secures the machine relative to the gallery floor with a force which is added to its weight and sets up an extra force of adhesion.

To adapt the anchoring device for use in galleries of different widths, each of the cylinders of the jacks 32 is screwed into one end of an internally screwthreaded sleeve 37 having screwthread portions at opposite ends thereof, the two screwthread portions being in opposite senses. The other end of the sleeve 37 is screwed to a screw 38 pivotally connected to the edge of the frame 1. The sleeve 37 can be rotated to change the length of the anchoring device, which can be adapted to different gallery widths, as shown in FIG. 10.

Referring to FIGS. 11A and 11B a machine in accordance with the invention includes a frame 1 bearing against the floor 3 of a gallery via four lifting jacks 58. An arm 7 is connected to the front of the frame via a pivotal connection 8. The connection 8 comprises a substantially vertical shaft 9 rotatably mounted in bearings 10 secured to the frame 1. The arm 7 is pivotally connected to a protrusion extending from pivotal connection 8 on a transverse shaft 11 whose axis is substantially perpendicular to the plane of the frame 1 when the axial plane of the arm 7 and the axial plane of the frame 1 coincide.

A drum 12 is keyed to the shaft 9. Wound on the drum 12 are two parallel cables 55 whose ends are connected to two rocking levers 56 respectively pivotally connected to the piston rods of jacks 13 attached to the frame 1. Parts of the cables which do not leave the drum are locked by flanges 57 on the drum 12. Two levers 14 are keyed to the two ends of the shaft 11. The free end of each lever 14 is pivotally connected on the one hand to a jack 15 connected to the arm 7 and on the other to a jack 16 pivotally connected to frame 1. A cross-piece 17 interconnects the free ends of levers 14. The assembly of the jacks 15, 16 is intended to pivot the arm 7 on the pivot 11.

The machine illustrated in FIGS. 11A and 11B may be displaced longitudinally by an axial cylinder (not shown) pivotally connected on the one hand to the end of the frame 1 and on the other to the rear of sleeper 23. Deflection is performed by a jack (not shown) corresponding to jack 29 controlling a lever (not shown) in FIG. 8. A spoil loading device and an axial spoil-evacuating conveyor, identical with those of the machine illustrated in FIG. 1, are connected to the four jacks 58. The frame 1 has a device for anchoring it to the floor similar to that illustrated in FIGS. 9 and 10 but differing from the latter by the feature that an extending jack 59 is interposed between each pivoted connection fixed to the frame and each anchoring jack 32.

To excavate a gallery using the machine illustrated in FIGS. 11A and 11B, a start is made with the frame in the bottom position, as shown in FIG. 11A, whereafter the lower part of the cutting front 18 is excavated over a surface 30. Then, using the jacks 58, the whole machine is lifted except for the spoil loading and conveying means, to bring the machine into its raised position. At the same time the jacks 59 are extended to keep the jacks 32 in contact with the anchoring rails 34. The machine is then in the position illustrated in FIG. 11B in which it excavates the upper part of the front 18 over a surrace 31. The cutting of the front is identical with that obtained using the embodiment of the invention described above. When excavation has been completed with the machine in one position, the machine is lowered again, and then advanced by means of the jacks 22. It must be understood that a machine in accordance with the invention may have two arms 7 on the chassis 4 or frame 1.

A further embodiment of a machine in accordance with the invention is illustrated in FIGS. 12 to 14. In this embodiment the machine comprises a frame 1 mounted on an arrangement 2 of jacks which not only displace the machine in the direction of forward movement, but also enable the frame 1 to be displaced transverely and horizontally of such direction, so that it may occupy a second excavating position adjacent a first excavating position. The arm 7 is unchanged and connected to the frame 1 in the same way as in the previously described embodiments of the invention.

In FIG. 12 the arm 7 is shown in solid lines in a bottom position and in chain lines in a horizontal position. In the machine illustrated in FIGS. 12 to 14, a transverse lever 12 is keyed to the shaft 9 and is connected to the jacks 13. Pivotally connected to the front and rear walls of the frame 1 are two displacement arrangements 2 of jacks the control system of which is designed to produce larger transverse traversing movements than longitudinal traversing movements.

Each arrangement 2 is formed by two parallel lifting jacks 22 and a sleeper 23 which rests on the gallery floor. Each jack 22 is pivotally connected by its piston rod to the frame 1 by means of a universal joint and is pivotally connected by its cylinder to the sleeper 23, also by means of a universal joint.

As shown in FIG. 15, the two sleepers 23 are rigidly connected by a cross-piece 25. The cross-piece 25 bears two upstanding flanges 26 between which the longitudinal arm of a cruciform double slide 39 can slide. The transverse arm of the slide 39 can slide between the flanges which support it, and the arm of slide 39 is secured to the lever 27 which is retained by a pivot 28 around which it can rotate. The pivot 28 is attached to the end of the frame 1.

Two axially disposed jacks 24 mounted in opposition, are pivotally connected by their cylinders to the ends of the frame 1 and each bear, at the end of their piston rods, a roller 40 which can roll along a guide 41 attached to a sleeper 23. The jacks 24 displace the machine longitudinally. But for the considerable disproportion between the longitudinal and transverse steps, instead of having the rollers 40, the jacks 24 would also be pivotally connected to the cross-piece 25 or the sleepers 23.

Two jacks 42 displace the machine transversely. Each of them is pivotally connected by means of universal joints on the one hand to a sleeper 23 and on the other to the frame 1. Lastly, a deflecting jack 29 is pivotally connected to the frame 1 on the one hand and to the lever 27 on the other.

To excavate a gallery using the machine illustrated in FIGS. 12 to 14, first the machine is placed by means of jack arrangements 2 in its first excavation position, i.e., to the right of the axial plane of the gallery.

Using the jack 15 (or 16), the arm 7 is placed in the position considered most suitable, for instance, in the horizontal position illustrated in chain lines in FIG. 12 and, using the jacks 13, the arm 7 is moved to the left of the axial plane of the gallery. The tool carrier 19 is brought into contact with the excavation front 18 at the point A. The tool carrier 19 occupies the position shown in chain lines in FIG. 13.

The machine can be placed in this way spaced from a wall since the tool carrier 19, which is disposed outside the sector where it is to operate, forms no obstacle to forward movement.

The tool carrier 19 is rotated, and cutting starts by the actuation of the jacks 13 which pivot the arm 7 to the right. A first "chip" of rock, in the form of a truncated crescent, is detached between A and B.

The arm 7 is then raised (or lowered), continuing to excavate, by a height equal to the diameter of the tool carrier, using the jack 15 (or 16) which immobilizes arm 7 at the required level to enable it to excavate during a fresh horizontal pass, the arm being moved, by actuating the jacks 13, from B in the direction of A. Half the surface of the excavation front 18 accessible from the position occupied by the machine then continues to be swept.

When the excavation of the right-hand half of the front 18, corresponding to AB, is completed, such part of the front takes the form of a substantially spherical surface 30 (FIG. 13).

The machine is then displaced to the left using the jack arrangements 2. The lifting jacks 22 slightly lift the sleepers 23 and are then locked. The jacks 42 then come into action to displace the sleepers 23 transversely of the axial plane of the machine. The transverse arm of the cruciform slide 39 slides in the flanges 26 of the lever 27, which is immobilized by the deflecting jack 29. The guides 41 slide on the rollers 40. When the sleepers 23 are displaced by the maximum distance permitted by the stroke of the jacks 42, the latter deposit the sleepers 23 on the floor.

Then, bearing against the sleepers 23, the jacks 22 slightly lift the frame 1 and are then locked. The jacks 42 are reversed to displace the frame 1 transversely by a length equal to that by which the sleepers 23 have just been displaced. Then the frame 1 is deposited on the floor by the jacks 22. If necessary, other transverse displacements of the frame 1 are performed in a similar manner.

When these operations are completed, the machine occupies its second excavating position, symmetrical to the first excavating position, in relation to the axial plane of the gallery.

The second half of the excavation front 18 is then attacked from the point C, performing movements symmetrical to those which were carried out during the excavation of the first part of the front.

When the excavation of the left-hand half of the front 18 has been completed, that part of the front takes the form of a substantially spherical surface 31. The surfaces 30 and 31 intersect one another along a vertical line situated in the axial plane of the gallery, and the same advantages derive from this situation as those resulting from the shape of the front excavated using the first described embodiment of a machine in accordance with the invention.

FIGS. 17 to 19 illustrate another embodiment of the invention. In this embodiment, the machine is displacable, transversely on a platform on which it can be locked in two well-defined positions. The platform can be anchored to the floor by a device which can be adapted to the width of the gallery to be excavated. In principle the machine illustrated in FIGS. 17 to 19 is very similar to that illustrated in FIGS. 12 to 14. However, in the embodiment illustrated in FIGS. 17 to 19 a drum 12 is secured to shaft 9 as in the case of the machine illustrated in FIG. 11. The platform 43 is a rectangular frame formed by two beams 44 which extend transversely of the excavating direction and are interconnected via two struts 45. Two anchoring devices 46 are pivotally connected to the two ends of the beams 44. Each device 46 consists of two parallel members pivotally connected on the one hand to the beams 44 and on the other to a longitudinal beam 48 which such members support. The two devices 46 are kept apart as required by two tie rods 49 of adjustable length pivotally connected by their ends to the members 47 or beams 48.

Suspended from each beam 48 are anchoring means consisting, in this embodiment, of a series of small arrangements of jacks 50 of generally parallelogram form with substantially horizontal bases which can be deformed by anchoring jacks 32, the two inclined sides of the parallelograms being associated with bent levers 51. Pivotally connected to the free ends of the levers 58 are bars 52 which in turn are pivotally connected via their bottom ends to jaws 33 which engage with the heads of sleeves 35 screwed to rods 36 sealed in the gallery floor 3. The bars and jaws form further parallelograms whose sides are parallel to those of the parallelograms 50. The jaws 33 of the devices 46 form a continuous line of engagement constantly parallel with the base of the parallelograms 50.

The frame 1 rests on the two transverse beams 44 and can inter alia occupy on such beams 44 two well-defined positions which are symmetrical in relation to the axial plane of the platform 43. To lock the frame 1 in these well-defined positions, the beams 44 are provided at suitably selected points with stops 53 having inclined lower faces. At places adjacent the stops 53, the frame 1 bears locking jacks whose piston rods terminate in clamping wedges having the same inclination as the inclination of the lower faces of the stops 53. The introduction of the clamping wedges of the locking jacks beneath the stops 53 effectively connects the frame 1 to the platform 43. To anchor the platform 43, the jacks 32 exert a thrust on the bent levers 51 to which they are connected, and this results in a pull on the bars 52, then on the jaws 33 and finally on the rods 36 anchored in the floor. The resulting anchoring force is added to the weight of the machine and platform to produce an extra force of adhesion. The machine operates in each of the two positions which it must occupy on the platform 43, just like the machine which is moved transversely as described above.

The machine is displaced on the platform by a winch having a vertical axis and attached to the frame 1, on whose drum two cables are wound in opposite senses. The cables run over pulleys attached to the struts 45 and their free ends are attached to the frame 1. The advance, withdrawal or deflection of the machine and platform 43 are performed by arrangements of jacks 2 of the machine after the latter has been connected to the platform using the locking jacks.

FIG. 20, illustrates a further machine which is substantially identical with that illustrated in FIGS. 17 to 19 and placed like the latter on a platform 43, the machine being pivotable around a vertical shaft or a rim attached to the platform, so that it can occupy two distinct positions, one to the right and the other to the left of the plane of symmetry of the platform 43. The machine is locked to the platform in each of these positions.

The platform 43 has a shaft 5 which engages in the rear part of the frame 1. Also, as shown by FIG. 2, the platform 43 comprises a cylindrical front wall whose axis is the pivoting axis of the machine. The wall is provided with a groove 60. The frame 1 also has a base whose inner flank is also cylindrical; it is concentric with the front wall of the platform and is formed with a groove 61. The upper wall of the groove 61 has an inclined face, the lower wall bearing on its inside face a surface with a high coefficient of friction. The walls of the two grooves 60, 61 penetrate into one another. Disposed radially on the platform 43 at suitably selected places are locking jacks 62 whose piston rods terminate in wedges. A positioning jack 63 connected to the frame 1 on one hand and the platform 43 on the other is used for pivoting the machine.

To excavate a gallery using the machine illustrated in FIG. 20, the jack 63 is actuated to move the machine into its first excavating position, for instance, the position shown in solid lines in FIG. 20, the vertical axis of rotation of the arm 7 being at 01.

The jacks 62 are then actuated to introduce the wedges under the inclined face of the groove 61. The frame 1 is slightly raised, this resulting in locking the surface of the lower wall of the groove 61 against the lower face of the upper wall of the groove 60, thus effectively connecting the machine and the platform.

Excavation is performed in two stages, in the same way as with the transversely moving machines illustrated in FIGS. 12 to 14 and 17 to 19. After the first half of the front has been excavated, the left-hand half in this example, the locking of the machine and the platform is released and the jack 63 places the machine in its second excavating position, the vertical axis of rotation of the arm 7 then being at 02. FIG. 20 shows the orientation of the frame 1 in chain lines. The shape of the resulting excavation front is identical with that obtained with the machines in the second embodiment.

To advance the machine by one step, the jack 63 places the frame in the axis of symmetry of the platform, the bolts are locked, and then the front and rear jack arrangements perform the displacement of the assembly formed by the machine and the platform. If necessary the platform 43 can have anchoring means.

FIG. 22 illustrates a further machine which is very advantageous for the excavation of galleries which rise at a considerable inclination.

One of the machines illustrated in FIGS. 1 to 3, 17 to 19 or 20, for instance, may move on rails anchored to the floor. FIG. 23 shows a machine having a tilting chassis and whose frame 1 has on its lateral sides toothed wheels 64 driven by a motor and step-down gears mounted in the frame and meshing with two racks 65 disposed on the upper flange of the rails 34.

The rails 34 are placed end-to-end, in two longitudinal rows on either side of the machine. In principle these are short rails which fit into one another and are anchored individually on the floor.

As can be seen in FIGS. 23 and 24, in this case a rail 34 is a small beam having a lower flange resting on the floor, an upper flange supporting a rack element 65 and a flat 66 whose upper face is slightly inclined. The two flanges are connected by two webs close together. At one end of the rail a tenon is welded between the two webs, while at the other end the space between the webs is empty and forms a mortice in which the tenon of the adjacent rail engages. The bottom flange of a rail 34 is formed with a small hole through which the shank of a anchoring bolt extends, its nut afterwards being tightened on such lower flange. Welded to the same flange, but on the other side of the webs, is a member whose top co-operates with a groove. Welded to the frame 1, at the margin of the longitudinal edges are two rings engaging in the groove, and the base of each of the sides of the frame 1 is formed with a further groove 61, adapted to accommodate flat 66 the bottom wall of such groove bears a fitting with a high coefficient of friction. The bottom of the groove is crossed by jacks 62 which are disposed transversely of the rails and whose piston rods terminate in wedges.

To excavate a gallery using the machine thus equipped, the toothed wheels 64 engaging with the racks 65 first advance the machine until it occupies its working position. When the machine is immobilized, the jacks 62 push their wedges on to the flats 66, thus slightly lifting the machine, locking the fittings of the lower wall of the groove 61 against the lower faces of the top flanges of the rails 34, and thus completely connecting the machine to the rails 34 anchored to the floor, without the bearings of the toothed heels being subjected to high pressures.

FIG. 23A shows a toothed wheel 64 meshing with the rack 65 of rail 34. This is the situation existing during the displacement of the machine.

FIG. 23B shows the wedge advanced, the frame 1 and also the toothed wheel 64 being raised. The toothed wheel 64 no longer fully meshes with the rack 65. The frame 1 is locked against the rail 34. This is the situation existing when the machine is connected to the rail and thereby anchored to the floor. FIG. 24 is an elevational view of this.

Excavation is performed by a technique suited to the machine. During excavation, fresh anchoring holes are drilled using drilling devices attached to the machine, and rails not used are taken from the rear and replaced in front of the machine.

FIGS. 25 and 26 shows a machine moving on rails which have no rack and are anchored to the floor. The machine is followed by a trailer 67 to which it is connected via a traversing jack 68. The machine and trailer 67 can slide on the upper face of the rails and be locked by the same means as the machine on racks, or by the engagement of two toothed surfaces with a high coefficient of friction.

The machine and trailer also have locking detents 69 which immobilize the machine and trailer against the rail anchoring bolts if the locking system fails; the axis of rotation of the detends has a different orientation from that of the axis of symmetry of the machine.

Advancing movements of the machine and trailer are performed as follows: the jacks 62 of the machine are released, while those of the trailer remain locked. Bearing against the trailer 67, the jack 68 pushed the machine and displaces it by one step. The jacks 62 of the machine then again lock against the rails.

The trailer is then displaced. Its jacks 62 are released, while those of the machine remain locked. Bearing against the machine, the jacks 68 pulls the trailer and also displaces it by one step. Then the jacks 62 of the trailer again lock it against the rails. The rails are reused, as in the preceding case, by removing the rails from behind the machine and then again placing the rails in front of the machine.

In each of the above described embodiments of the machine according to the invention, the single tool carrier 19 can be replaced by a number of tool carriers whose axes of rotation are parallel with one another and also with the direction of the arm 7, their tools operating in a single plane perpendicular to the axes of rotation.

I claim:

1. A machine for excavating underground galleries comprising a frame movable to advance in a forward movement generally along an axis in the direction of excavation within a gallery which is being excavated, tool carrying arm means, pivotal connecting means for connecting said arm means to said frame for vertical swinging movement, means for adjusting the orientation of said arm in a plurality of directions with respect to a vertical plane, said arm means including a rotary tool carrier supported thereon and provided with cutting tools distributed over the periphery thereof and positioned to operate in a plane perpendicular to the direction of said arm, means for rotating said rotary tool carrier, means for moving said pivotal connecting means to occupy at least two alternative positions above the floor of the gallery being excavated having different displacements transverse to said axis in the direction of excavation to thereby provide for excavation at different ranges of transverse displacement, said pivotal connecting means including operable for imparting said vertical swinging movement to said arm means during excavation rotation of said rotary tool carrier in each of said alternative positions of said pivotal connecting means to thereby provide a vertical swinging excavating movement from each of said positions.

2. A machine according to claim 1 comprising a sub-frame carrying said pivotal connecting means and pivotally connected to a horizontal shaft which is perpendicular to the vertical plane of symmetry of the machine pivoting means for moving said sub-frame in a vertical plane around said horizontal shaft between a bottom position and a top position, said sub-frame being immobilizable by said pivoting means in each of said positions.

3. A machine according to claim 2 wherein said pivoting means are jacks.

4. A machine according to claim 3 wherein said jacks are hydraulic jacks.

5. A machine according to claim 1 wherein said machine is provided with lifting jacks, parts of said lifting jacks are arranged to rest on the gallery floor, means for loading and conveying spoil connected to said parts of said jacks which rest on the floor, the rest of the machine being connected to those parts of the jacks which can be lifted.

6. A machine according to claim 1 comprising displacing and positioning means consisting of two deformable paralelogram shaped assemblies of jacks pivotally connected to two opposite vertical faces of the frame.

7. A machine according to claim 6 wherein each parallelogram shaped assembly comprises at least two parallel lifting jacks pivotaly connected to the frame, and a horizontal sleeper.

8. A machine according to claim 7, wherein each parallelogram also comprises a diagonal jack which deforms the parallelogram shaped assembly.

9. A machine according to claim 7 wherein the sleepers of the two parallelogram shaped assemblies are rigidly interconnected by means of a cross-piece.

10. A machine according to claim 9 wherein a jack connected to the frame and to the combination of the cross-piece and a sleeper deforms the parallelograms.

11. A machine according to claim 9 wherein the frame has a vertical pivot, a lever rotatable about said pivot, the lever being slidable between two flanges disposed on the cross-piece, and being movable to move said sleepers relative to the frame to effect a traversing movement.

12. A machine according to claim 11 wherein a deflecting jack is connected to the frame and to the lever.

13. A machine according to claim 9 wherein the frame has a vertical pivot, a lever rotatable about said pivot, which lever supports by means of two flanges a double slide member which can be displaced between such flanges in a first traversing direction, the slide also being able to slide between two other flanges attached to the cross-piece, in a second traversing direction perpendicular to the first.

14. A machine according to claim 13 wherein at least one axially disposed jack is provided and connected to the frame and to the combination of the cross-piece and the sleepers to provide the displacement in the first traversing direction, two jacks are provided perpendicular to the axial plane of the machine and disposed symmetricaly in relation to the pivot and connected to the frame and to the combination of the cross-piece and the sleepers to perform the displacements in the second traversing direction, and the jack connected to the frame and the lever is operable to rotate the machine around the pivot.

15. A machine according to claim 1 comprising means for anchoring the displaceable frame to rods secured to the floor of a gallery.

16. A machine according to claim 15 wherein the rods are secured in the floor on either side of the machine, the means for anchoring the machine to such rods being jacks connected to the frame on either side thereof, a member attached to at least one of said rods, said last-mentioned jacks having jaws each of which exerts an axial pull on said member attached to said rod.

17. A machine according to claim 16 wherein said member attached to a rod comprises a rail.

18. A machine according to claim 16 wherein each anchoring jack is associated with two parallel levers which together with an elongate jaw are substantially parallel to the plane in which the machine is placed to define a parallelogram.

19. A machine according to claim 18 wherein the jaws associated with the anchoring jacks disposed on the same side of the machine are co-aligned to from a continuous gripping line substantially parallel to the plane in which the machine is placed.

20. A machine according to claim 17 wherein the rods are secured to the floor on either side of the machine, the means for anchoring the machine to such rods being jacks connected to the frame on either side thereof and having jaws which exert a force parallel with the axis of the rods on a rail attached to the rods, parallel with the floor, the rods and the rail being at an angle to the vertical.

21. machine according to claim 1 including on an advancable platform, said frame being horizontally displaceable upon said platform, said means for moving said pivotal connecting means comprising means to move said frame upon said platfrom to provide said two alternative positions for said pivotal connecting means, and means for locking said frame in each of such positons.

22. A machine according to claim 1 comprising on advancable platform, a vertical shaft connecting said frame to said platform around which said frame can be pivoted between two positions, said means for moving said pivotal connecting means comprising a jack connected between said platform and said frame, said jack being operable to immobilize said frame with respect to said platfrom at said two alternative positions.

23. A machine according to claim 22 wherein the platform has anchoring means which can be adapted to the width of the gallery.

24. A machine according to claim 23 wherein the anchoring means for the platform are disposed laterally on either side thereof and each consist of two parallel members pivotally connected to the platform at their bottom ends and pivotally connected at their top ends to a longitudinal beam which interconnects them and bears anchoring means and drilling means, the anchoring means being kept apart as required by tie rods to which they are connected.

25. A machine according to claim 24 provided with parallelogram shaped arrangements of jacks to perform the longitudinal displacements and changes in orientation of the associated machine and platform.

26. A machine for excavating underground galleries comprising a frame movable to advance in a forward movement generally along an axis in the direction of excavation within a gallery which is being excavated, tool carrying arm means comprising at least two arms, pivotal connecting means for connecting said arms to said frame for vertical swinging movement, means for adjusting the orientation of said arms in a plurality of directions with respect to a vertical plane, each of said arms including a rotary tool carrier supported thereon and provided with cutting tools distributed over the periphery thereof and positioned to operate in a plane perpendicular to the direction of the associated arm, means for moving said pivotal connecting means to occupy at least two alternative positions above the floor of the gallery being excavated having different displacements trnsverse to said axis in the direction of excavation to thereby provide for excavation at different ranges of transverse displacement, means for rotating said rotary tool carriers, said pivotal connecting means including means operable for imparting said vertical swinging movement to said arm means during excavation rotation of said rotary tool carriers in each of said alternative positions of said pivotal connecting means to thereby provide a vertical swinging excavating movement from each of said positions.

27. A machine according to claim 26, including displacing and orienting means consisting of two deformable parallelogram shaped assemblies of jacks pivotally connected to two opposite vertical faces of the frame.

28. A machine according to claim 27 wherein each parallelogram shaped assembly comprises at least two parallel lifting jacks pivotally connected to the frame and a horizontal sleeper.

29. A machine according to claim 28 wherein each parallelogram shaped assembly also comprises a diagonal jack which deforms the parallelogram shaped assembly.

30. A machine according to claim 28 wherein the sleepers of the two parallelogram shaped assemblies are rigidly inter-connected by means of a cross-piece.

31. A machine according to claim 30 wherein jack connected to the frame and to the combination of the cross-piece and a sleep deforms the parallelograms.

32. A machine according to claim 30 wherein a vertical pivot, a lever rotatable about said pivot, said lever being slidable between two flanges disposed on the cross-piece, and being movable to move said sleeper relative to the frame to effect a traversing movement.

33. A machine according to claim 32 wherein a deflecting jack is connected to the frame and to the lever.

34. A machine according to claim 30 wherein the frame has a vertical pivot around which a lever can rotate, which lever supports by means of two flanges a double slide member which can be displaced between such flanges in a first traversing direction, the slide also being able to slide between two other flanges attached to the cross-piece, in a second traversing direction perpendicular to the first.

35. A machine according to claim 34 wherein at least one axially disposed jack connected to the frame and to the combination of the cross-piece and the sleepers performs the displacement in the first traversing direction, two jacks perpendicular to the axial plane of the machine and disposed symmetrically in relation to the pivot and connected to the frame and to the combination of the cross-piece and the sleepers perform the displacements in the second traversing direction, and the jack connected to the frame and to the lever rotates the machine around the pivot.

36. A machine according to claim 26 comprising means for anchoring the displaceable frame to rods operable to be secured to the floor of a gallery.

37. A machine according to claim 36 wherein the rods are operable to be secured in the floor on either side of the machine, the means for anchoring the machine to such rods being jacks connected to the frame on either side thereof and having jaws each of which exerts an axial pull on a member attached to a rod secured to the floor.

38. A machine according to claim 37 wherein said member attached to a rod comprises a rail.

39. A machine according to claim 37 wherein each anchoring jack is associated with two parallel levers which together with an elongate jaw substantially parallel to the plane in which the machine is placed define a parallelogram.

40. A machine according to claim 39 wherein the jaws associated with the anchoring jacks disposed on the same side of the machine are co-aligned to form a continuous gripping line substantially parallel to the plane in which the machine is placed.

41. A machine according to claim 38 wherein the rods are operable to be secured to the floor on either side of the machine, the means for anchoring the machine to such rods being jacks connected to the frame on either side thereof and having jaws which exert a force parallel with the axis of the rods on a rail attached to the rods, parallel with the floor, the rods and the rail being at an angle to the vertical.

42. A machine according to claim 26 including an advanceable platform on which said machine frame can be displaced transversely to the direction of excavation between two predetermined positions symmetrical of the axial plane of the platform, means being provided for locking said frame to said platform in each of such positions.

43. A machine according to claim 1 including rails adapted to be anchored to the floor, said frame being supported upon said rails, the machine having means for displacing the machine relative to the rails, and having means for locking the machine to the rails.

44. A machine according to claim 43, wherein the means for displacing the machine relative to the rails are racks unitary with the rails and toothed wheels attached to the machine frame.

45. A machine according to claim 44 wherein the means for locking the machine to the rails are jacks having wedges, the frame having a surface spaced slightly from a corresponding surface of the rails, the wedge being inserted in said space to engage both said surfaces to lock the machine to the rails, the machine being lifted relative to rails by the action of said wedge, the toothed wheels at least partially disengaging from the corresponding racks.

46. A machine according to claim 43 including a trailer, a traversing jack connecting said trailer to said frame, said frame and trailer resting and being movable relative to rails adapted to be anchored to the floor, the frame and the trailer having locking means for locking the frame and the trailer in position, the means for locking the frame and the trailer being actuatable simultaneously and being actuatable alternately during the operation of the traversing jack.

47. A machine according to claim 46 wherein said frame and trailer locking means comprise jacks associated with wedges adapted to urge the wedges between spaced apart surfaces of the rails and the frame and trailer.

48. A machine according to claim 47 further comprising detents engageable with bolts operable for securing said rails to a gallery floor.

49. A machine for excavating underground galleries comprising a frame movable to advance in a forward movement generally along an axis in the direction of excavation within a gallery which is being excavated, tool carrying arm means, pivotal connecting means for connecting said arm means to said frame for vertical swinging movement, means for adjusting the orientation of said arm in a plurality of directions with respect to a vertical plane, said arm means including a rotary tool carrier supported thereon and provided with cutting tools distributed over the periphery thereof and positioned to operate in a plane perpendicular to the direction of said arm, means for moving said pivotal connecting means to occupy at least two alternative positions above the floor of the gallery being excavated having different displacements transverse to said axis in the direction of excavation to thereby provide for excavation at different ranges of transverse displacement, said arm means including a pluraltiy of tool carriers whose axes of rotation are parallel to one another and to the axis of said supporting arm, the tools of said tool carriers operating in a plane perpendicular to the axes of rotation thereof, means for rotating said rotary tool carriers, said pivotal connecting means including means operable for imparting said vertical swinging movement to said arm means during excavation rotation of said rotary tool carriers in each of said alternative positions of said pivotal connecting means to thereby provide a vertical swinging excavating movement from each of said positions.

50. A machine for excavating underground galleries comprising a frame movable to advance in a forward movement generally along an axis in the direction of excavation within a gallery which is being excavated, tool carrying arm means, pivotal connecting means for connecting said arm means to said frame for vertical swinging movement, means for adjusting the orientation of said arm in a plurality of directions with respect to a vertical plane, said arm means including a rotary tool carrier supported thereon and provided with cutting tools distributed over the periphery thereof and positioned to operate in a plane perpendicular to the direction of said arm, means for rotating said rotary tool carrier, means for moving said pivotal connecting means to occupy at least two alternative positions above the floor of the gallery being excavated having different displacements transverse to said axis in the direction of excavation to thereby provide for excavation at different ranges of transverse displacement, said pivotal connecting means including means operable for imparting said vertical swinging movement to said arm means during excavation rotation of said rotary tool carrier in each of said alternative positions of said pivotal connecting means to thereby provide a vertical swinging excavating movement from each of said positions, each tool carrier including finishing tools disposed in a plane which is parallel with that of the cutting tools, the finishing tools being retractable in both the axial and radial directions.

* * * * *

UNITED STATES PATENT AND TRADEMARK OFFICE

CERTIFICATE OF CORRECTION

PATENT NO. : 4,005,905

DATED : February 1, 1977

INVENTOR(S) : MICHEL DUBOIS

It is certified that error appears in the above-identified patent and that said Letters Patent are hereby corrected as shown below:

Abstract, line 7, "single" should be omitted.
Column 2, line 20, "sise" should read --side--.
Column 3, line 4, "FIS." should read --FIGS.--.
Column 4, line 23, "pieced" should read --piece--;
line 45, "semi-tagentially" should read --semi-tangentially--.
Column 5, line 3, insert --controls-- before "the rotation".
Column 13, line 10, "heels" should read --wheels--;
line 39, "detends" should read --detents--;
line 44, "pushed" should read --pushes--;
line 46, insert --it-- before "against".
Column 14, line 20, after "including" insert --means--;
line 31, insert a comma after "machine".
Column 15, line 47, "from" should read --form--;
line 58, insert --A-- before "machine".
Column 16, line 1, "on" should read --an--;
line 49, "trnsverse" should read --transverse--.
Column 17, line 8, insert --a-- before "jack";
line 10, "sleep" should read --sleeper--;
line 14, "sleeper" should read --sleepers--.

Signed and Sealed this

Third Day of May 1977

[SEAL]

*Attest:*

RUTH C. MASON
*Attesting Officer*

C. MARSHALL DANN
*Commissioner of Patents and Trademarks*

UNITED STATES PATENT OFFICE
CERTIFICATE OF CORRECTION

Patent No. 4,005,905 Dated February 1, 1977

Inventor(s) Michel Dubois

It is certified that error appears in the above-identified patent and that said Letters Patent are hereby corrected as shown below:

The attached drawing figures (14-23) should be inserted.

This certificate will apply to the Grant only.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*